US006207336B1

(12) United States Patent
Itaya et al.

(10) Patent No.: US 6,207,336 B1
(45) **Date of Patent: *Mar. 27, 2001**

(54) LIQUID DEVELOPING METHOD

(75) Inventors: Masahiko Itaya; Hiroyuki Nakagoshi; Tsutomu Sasaki; Tai Hasegawa; Toshihiro Saito; Yoshiyuki Tanaka, all of Tanaka (JP)

(73) Assignee: Research Laboratories of Australia PTY Ltd., Eastwood (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/065,437

(22) Filed: Apr. 24, 1998

Related U.S. Application Data

(60) Division of application No. 08/627,783, filed on Mar. 20, 1996, now Pat. No. 6,029,036, which is a continuation-in-part of application No. PCT/JP94/01541, filed on Sep. 20, 1994.

(30) Foreign Application Priority Data

| | | |
|---|---|---|
| Sep. 20, 1993 | (JP) | 5-259473 |
| Sep. 20, 1993 | (JP) | 5-259474 |
| Sep. 20, 1993 | (JP) | 5-259475 |
| Nov. 30, 1993 | (JP) | 5-325890 |
| Nov. 30, 1993 | (JP) | 5-325892 |
| Nov. 30, 1993 | (JP) | 5-325893 |
| Nov. 30, 1993 | (JP) | 5-325894 |
| Nov. 30, 1993 | (JP) | 5-325897 |
| Nov. 30, 1993 | (JP) | 5-325898 |
| Nov. 30, 1993 | (JP) | 5-325899 |

(51) Int. Cl.[7] ..... G03G 13/10; G03G 9/125
(52) U.S. Cl. ..... 430/119; 430/116; 430/117
(58) Field of Search ..... 430/116, 117, 430/118, 119; 499/239, 237, 241, 240

(56) References Cited

U.S. PATENT DOCUMENTS 3,540,885 * 11/1970 Honjo et al. ..... 430/119

(List continued on next page.)

FOREIGN PATENT DOCUMENTS 53-57039 * 5/1978 (JP) .

(List continued on next page.)

OTHER PUBLICATIONS

Japio Abstract AN 89–250976 of JP 01–1250976 (Pub. Oct. 1989).*

(List continued on next page.)

*Primary Examiner*—Janis L. Dote
(74) *Attorney, Agent, or Firm*—Evenson, McKeown, Edwards & Lenahan, P.L.L.C.

(57) ABSTRACT

A liquid developing method that uses a highly-concentrated liquid developing agent to develop an electrostatic latent image.

A highly-concentrated liquid developing agent with a viscosity of 100 to 1,000 mPa.s can be used. Therefore, a film of developing agent from 5 to 40 $\mu$m thick can be formed on the surface of the developing roller or developing belt and this provides a soft contact with the photosensitive member surface where the electrostatic latent image has been formed. If the surface of the photosensitive member does not have good release properties, a film of pre-wet liquid can be formed on the surface of the photosensitive member. A gap which is larger than the thickness of the liquid developing agent film and smaller than the sum of the thicknesses of the liquid developing agent film and the pre-wet liquid film is maintained between the surfaces of the photosensitive member and the developing roller or other developing agent bearing member such that the pre-wet liquid is always interposed between the two surfaces. Extremely good copies can be obtained if a 5 to 40 $\mu$m thin film of liquid developing agent with a viscosity of 100 to 10,000 mPa.s and containing toner with an average particle size of 1 to 5.0 $\mu$m at a concentration of 5 to 40% is used with a 30 $\mu$m or less thin film of pre-wet liquid with a viscosity of 0.5 to 5.0 mPa.s and the gap between the photosensitive member and the developing agent roller or other developing agent bearing member is set at 5 to 60 $\mu$m.

12 Claims, 22 Drawing Sheets

U.S. PATENT DOCUMENTS

| | | | | |
|---|---|---|---|---|
| 3,642,471 | * | 2/1972 | Sato et al. | 430/119 |
| 3,847,642 | * | 11/1974 | Rhodes | 430/117 |
| 3,910,231 | | 10/1975 | Inoue et al. . | |
| 4,004,931 | * | 1/1977 | Lu | 430/117 |
| 4,259,005 | * | 3/1981 | Kuehnle | 430/119 |
| 4,268,943 | * | 5/1981 | Watanabe et al. | 399/239 |
| 4,504,138 | | 3/1985 | Kuehnle et al. | 430/119 |
| 4,761,357 | * | 8/1988 | Tavernier et al. | 430/119 |
| 5,117,263 | * | 5/1992 | Adam et al. | 118/659 |
| 5,463,453 | * | 10/1995 | Kurotori et al. | 430/117 |
| 5,488,466 | * | 1/1996 | Abreu | 399/240 |
| 5,596,396 | * | 1/1997 | Landa et al. | 399/237 |
| 5,642,188 | * | 6/1997 | Mochizuki et al. | 430/116 |

FOREIGN PATENT DOCUMENTS

| | | | |
|---|---|---|---|
| 55-83076 | * | 6/1980 | (JP) . |
| 58-7387 | * | 2/1983 | (JP) . |
| 1-250976 | * | 10/1989 | (JP) . |
| 2-51177 | * | 2/1990 | (JP) . |
| 2-287477 | * | 11/1990 | (JP) . |
| 3-185471 | * | 8/1991 | (JP) . |
| 3-231782 | * | 10/1991 | (JP) . |
| 3-293384 | * | 12/1991 | (JP) . |
| WO94-17453 | * | 8/1994 | (WO) . |

OTHER PUBLICATIONS

Japio Abstract AN 91–231782 of JP 03–231782 (Pub. Oct. 1991).*

Japio Abstract AN 91–185471 of JP 03–185471 (Pub. Aug. 1991).*

Japio Abstract AN 80–083076 of JP 55–083076 (Pub. Jun. 1980).*

Japio Abstract AN 91–293384 of JP 03–293384 (Pub. Dec. 1991).*

Japio Abstract AN 83–007387 of JP 58–007387 (Pub. Feb. 1983).*

Japio Abstract An 90–287477 of JP 02–287477 (Pub. Nov. 1990).*

Japio Astract AN 90–051177 of JP 02–051177 (Pub. Feb. 1990).*

Derwent Abstract AN 78–46868A of JP 53–057039 (Pub. May 1978).*

Grant & Hackh's Chemical Dictionary, 5th Edition, McGraw–Hill Book Company, NY (1987) pp. 459 & 564.*

ACS File Registry RN 556–67–2 Copyright 1998.*

AiChE DIPPR RN 556–67–2 DIPPR Copyright 1998,*

Patent & Trademark Office English–Language Translation of JP 53–057039 (Pub. May 1978).*

ACS File Registry RN 541–02–6 Copyright 1999.*

AICHE DIPPR RN 541–02–6 Copyright 1999.*

* cited by examiner

LIQUID DEVELOPING METHOD

CROSS REFERENCE TO RELATED APPLICATIONS

This application is a Divisional of U.S. patent application Ser. No. 08/627,783, lodged Mar. 20, 1996, now issued U.S. Pat. No. 6,029,036, issued on Feb. 22, 2000, which was a Continuation-in-Part of PCT Application No PCT/JP94/01541 dated Sep. 20, 1994.

FIELD OF THE INVENTION

This invention relates to a liquid developing method and a liquid developing apparatus that use a liquid developing agent to make visible images from electrostatic latent images formed by electrophotography, electrostatic recording, ionography, or other methods.

BACKGROUND OF THE INVENTION

Many examples of the apparatus in related art are embodiments of the Carlson dry contact method in which a powder developing agent is used as the developing agent that develops visible images from electromagnetic latent images. The apparatus transfers and fixes the toner used to make visible images from the electrostatic latent images, formed by electrophotographic or other methods, to the paper or other recording medium. This method is used because of advantages such as the high energy amplification factor and high processing speeds. Disadvantages of this method include the amount of toner dispersion caused by use of a powder developing agent, and the poor resolution caused by the large size of the toner particles (7 to 10 $\mu$m). In addition, the powder does not flow easily and is difficult to stir, which makes it difficult to obtain uniform images over a wide range.

Accordingly, there is a need for wet developing when higher resolutions and improved tonal reproduction are required. The size of the toner particles used in wet developing is 0.1 to 0.5 $\mu$m, which is about a tenth of the size of the particles in dry developing agents. In addition, the toner has a high charge amount and toner image inaccuracies do not easily occur.

However, the liquid developing agent usually used in the wet style of electrostatic recording apparatus has low viscosity. These low-viscosity liquid developing agents consist of ISOPAR G® (ISOPAR G® is a registered trademark of the Exxon Corporation), an organic solvent, in which toner is mixed at a proportion of about 1 to 2%. Since the proportion of toner is small, the above style of apparatus in related art requires large quantities of the liquid developing agent, which makes reductions in the size of the apparatus difficult. In addition, the ISOPAR® (registered trademark) used as the dielectric liquid (carrier liquid) is highly volatile and releases an unpleasant odour. Therefore, use of the apparatus of related art adversely affects the work environment and has negative environmental effects.

Hence, it is desirable to develop a developing method that uses a non-toxic and odourless carrier, such that the apparatus does not need to be tightly sealed, and that uses a more highly concentrated liquid developing agent. However, many aspects of the technology concerning use of a highly concentrated liquid developing agent with electrostatic latent image development methods were heretofore unknown. For example, development of techniques to improve the selectivity between image parts and non-image parts for toner adhesion during the development process and to improve performance during the separation process was required.

In the wet methods of developing electrostatic latent images in related art, the electrostatic latent images formed on the image bearing member are made into visible images by toner, which consists of charged developing particles. In these methods, use of the same distribution medium as the medium used to distribute the liquid developing agent to apply a pre-wet liquid on the image bearing member before the actual developing process begins is a well known means of preventing the adhesion of toner to the non-image parts of the image bearing member and thereby preventing toner inaccuracies. Various methods can be used to apply the pre-wet liquid. For example, the same method as that used to supply liquid developing agent to the latent image surface of the image bearing member, in which the developing agent bearing member is a sponge roller, may be considered. Alternately, a roller with depressions and protuberances may be used as the member that supplies the pre-wet liquid. This roller is brought into contact with the image bearing member in order to apply the pre-wet liquid (Japanese Unexamined Patent Publication No. 60-147751 of 1985). Or, a blade provided with a slit from which pre-wet liquid flows may be used. In this method of applying the pre-wet liquid, the blade is positioned near to but not touching the image bearing member such that the pre-wet liquid forms a liquid bank between the image bearing member and the blade (Japanese Unexamined Patent Publication No. 4-1687 of 1992).

However, in order to achieve an extremely thin and uniform film of pre-wet liquid, the roller and image bearing member touch in the method disclosed in Japanese Unexamined Patent Publication No. 60-147751 of 1985. This damages the image bearing member and lowers developing performance. In the method disclosed in Japanese Unexamined Patent Publication No. 4-1687 of 1992, it is difficult to maintain a fixed distance between the blade and the image bearing member. Therefore, the pre-wet liquid cannot be applied at a uniform thickness and, consequently, it is impossible to adequately prevent toner adhesion to the non-image parts on the image bearing member.

The above types of pre-wet application methods in related art can be used when the liquid developing agent has low viscosity and consists of the organic solvent ISOPAR G® (registered trademark) in which toner is mixed at proportions from 1 to 2%. However, the types of methods that satisfactorily prevent toner from adhering to the non-image parts on the image bearing member when a liquid developing agent such as the one implemented in this invention is used, that is, when the liquid developing agent has the toner dispersed in the dielectric liquid at higher concentrations and has a higher viscosity of between 100 and 10,000 mPa.s, were heretofore unknown. Since the adhesion of this type of highly viscous liquid developing agent to the surface of the image bearing member is greater, development of an appropriate method for preventing toner adhesion was required.

In related art, a charged transfer member that carries an electric charge of opposite polarity to the toner is brought up against the image bearing member through the medium of the recording medium in order to transfer the toner image, which has been formed on the surface of the latent image on the image bearing member, to the recording medium.

When liquid developing agents are used, the image that is transferred to the recording medium can spread if the pressure of the recording medium against the image bearing member is too high. The measures heretofore taken to deal with this problem relate to the liquid developing agents usually used in the wet style of electrostatic recording apparatus and other apparatus in related art, that is, to liquid developing agents that have low viscosity and that consist of the organic solvent ISOPAR G® (registered trademark) in which toner is mixed at proportions from 1 to 2%. However, when highly concentrated liquid developing agents with high viscosity are used, the types of methods that satisfactorily transfer the toner image formed on the surface of the latent image on the image bearing member to the recording medium without the image spreading were heretofore unknown.

This invention is a response to the above mentioned circumstances and is intended to provide a liquid developing method and liquid developing apparatus that will reduce pollution, improve the work environment, and enable easy development of electrostatic latent images at high resolutions in apparatus of reduced size.

Another aim of this invention is to provide a liquid developing method and liquid developing apparatus for developing electrostatic latent images such that pre-wet liquid can be applied at a uniform thickness to the image bearing member without causing damage to the image bearing member and such that, as a result, toner can be prevented from adhering to the non-image parts on the image bearing member.

A further aim of this invention is to provide a liquid developing method and liquid developing apparatus for developing electrostatic latent images such that, when a highly viscous liquid developing agent in which toner is dispersed at high concentrations is used and the liquid developing agent layer formed on the developing agent bearing member touches the pre-wet liquid layer formed on the image bearing member during the developing process, the pre-wet liquid layer and the liquid developing agent layer form a two-layer structure in order to prevent the occurrence of inaccuracies in the liquid developing agent layer and to allow full utilization of the function of the pre-wet layer such that, as a result, the adhesion of toner to the non-image parts of the image bearing member and the occurrence of inaccuracies in the image can be prevented.

Yet another aim of this invention is to provide a liquid developing method and liquid developing apparatus that can prevent toner image inaccuracies occurring when the toner image formed on the latent image surface of the image bearing member touches the recording medium and that can, as a result, transfer the toner image to the recording medium without the image spreading.

DISCLOSURE OF THE INVENTION

The inventors et al. found that use of an extremely thin film of highly concentrated developing agent during developing enables toner to adhere selectively to the image part of an electrostatic latent image on an image bearing member without the toner adhering to the non-image part. Accordingly, the liquid developing method of this invention, wherein electrically charged toner is applied to the surface of the developing agent bearing member in order to develop the electrostatic latent images formed on the surface of the image bearing member, has the following features: provision of a developing agent bearing member; a process that forms a 5 to 40 $\mu$m film of liquid developing agent on the surface of said developing agent bearing member, wherein the liquid developing agent is formed from toner dispersed in a dielectric liquid and has a viscosity of 100 to 10,000 mPa.s; and provision of a developing process that supplies said liquid developing agent to the surface of the above electrostatic latent image by means of bringing the above developing agent bearing member adjacent to the above image bearing member such that the film of liquid developing agent is brought into contact with the electrostatic latent image on the image bearing member.

In addition, the inventors et al. found that clean images are not produced when the release properties of the image bearing member are inadequate, but that practical and effective release properties can be obtained by application of an extremely thin layer of pre-wet liquid to the image bearing member. Accordingly, provision of a pre-wet process that forms a film of pre-wet liquid on the surface of the image bearing member, wherein the pre-wet liquid has good release properties, is chemically inert, and is dielectric, is desirable for the liquid developing method of this invention.

Further, during the developing process, it is desirable that the image bearing member on which the pre-wet liquid film is formed and the developing agent bearing member on which the liquid developing agent film is formed be disposed such that they are separated by a gap that is larger than the thickness of the liquid developing agent film and smaller than the sum of the thicknesses of the pre-wet film and the liquid developing agent film. As a result, the pre-wet liquid film and the liquid developing agent film are made to touch and the toner makes a visible image from the electrostatic latent image formed on the surface of the image bearing member.

In the liquid developing method of this invention, the thickness of the pre-wet liquid film may be 30 $\mu$m or less, and the gap between the surface of the developing agent bearing member and the surface of the image bearing member may be from 5 to 60 $\mu$m.

The dielectric liquid may be a liquid wherein the viscosity is from 0.5 to 1,000 mPa.s, the electric resistance is $10^{12}$ Ωcm or more, the surface tension is 21 dyn/cm or less, and the boiling point is 100° C. or more.

The liquid developing method of this invention functions extremely well when the dielectric liquid is silicone oil and contains toner that has an average particle diameter of from 0.1 to 5.0 $\mu$m at concentrations from 5 to 40% by weight of the developing agent.

In addition, a pre-wet liquid wherein the viscosity is from 0.5 to 5.0 mPa.s, the electric resistance is $10^{12}$ Ωcm or more, the surface tension is 21 dyn/cm or less, and the boiling point is 100 to 250° C. is desirable.

Silicone oil is the preferred pre-wet liquid.

It is desirable that at least one of the image bearing member or the developing agent bearing member be flexible and that the tension of the flexible bearing member be adjusted to maintain the appropriate gap from the surface of the image bearing member.

In addition, it is desirable that the pre-wet liquid supply element be formed from a liquid-permeable and liquid-retentive elastic element and be impregnated by the above pre-wet liquid such that, when brought into contact with the image bearing member during the pre-wet process, a film of pre-wet liquid of the above thickness is formed on the surface of the image bearing member. The preferred elastic material is a continuously porous sponge that has a three-dimensional mesh structure in which the pores are three-dimensionally continuous.

The pre-wet liquid supply element may be formed as a cylindrical shape and rotated in accord with the direction of the movement of the image bearing member in order to form a film of pre-wet liquid on the surface of the image bearing member. Alternatively, a pre-wet liquid supply element that is formed in a plate shape wherein the pre-wet liquid flows from one edge to the other and the side is brought into contact with the image bearing member to apply the pre-wet liquid to the surface of the image bearing member is extremely favourable. Or, the pre-wet liquid supply element may be formed in a plate shape wherein the pre-wet liquid is absorbed from one edge and the other edge is brought into contact with the image bearing member to apply the pre-wet liquid.

In addition, it is desirable that a recording medium be disposed on the transfer member, that a transfer process be provided wherein the toner image that makes the electrostatic latent image visible is transferred to the recording medium, that either the transfer member or the image bearing member be flexible, and that the tension of the flexible bearing member be adjusted to maintain the appropriate contact pressure between the surfaces of the transfer member and the image bearing member.

In order to achieve the above aims, the liquid developing apparatus of this invention, wherein electrically charged toner is applied to the surface of the developing agent bearing member to develop the electrostatic latent images formed on the surface of the image bearing member, has the following features: an image bearing member that moves in one direction and that has a surface on which electrostatic latent images can be formed; a developing agent bearing member that moves in accord with the image bearing member and that has a surface that can carry liquid developing agent; provision of a developing agent supply mechanism that forms a 5 to 40 $\mu$m film of liquid developing agent on the surface of the developing agent bearing member, wherein the liquid developing agent is formed from toner dispersed in a dielectric liquid and has a viscosity of 100 to 10,000 mPa.s; and the supply of liquid developing agent to the surface of the electrostatic latent image by means of bringing the developing agent bearing member adjacent to the image bearing member during developing.

Provision of a pre-wet apparatus that forms a film of pre-wet liquid on the surface of the image bearing member, wherein the pre-wet liquid has good release properties, is chemically inert, and is dielectric, is desirable for the liquid developing apparatus of this invention.

In addition, it is desirable that at least one of the image bearing member or the developing agent bearing member be formed from a flexible material.

Further, it is desirable that the gap disposed between the surface of the image bearing member and the developing agent bearing member be larger than the thickness of the liquid developing agent film and smaller than the sum of the thicknesses of the pre-wet liquid film and the liquid developing agent film.

When the image bearing member is a drum with a surface formed of photosensitive material, the developing agent bearing member may be comprised of a flexible wheel-shaped belt that carries liquid developing agent on the outside surface. The tension of the belt of the developing agent bearing member can be adjusted to maintain the appropriate gap between the belt surface and the image bearing member.

The belt of the development agent bearing member may be a seamless nickel belt.

A conductive belt is desirable for the developing agent bearing member. The belt may take the form of a seamless resin belt to which minute conductive particles are added or a seamless polyimide film belt to which a conductive process has been applied.

The preferred pre-wet liquid supply element in the pre-wet mechanism is a liquid-permeable and liquid-retentive elastic material in the form of a continuously porous sponge that has a three-dimensional mesh structure in which the pores are three-dimensionally continuous.

The pre-wet liquid supply element may be formed as a cylindrical shape that abuts the above image bearing member and rotates in accord with the direction of rotation of the image bearing member. Alternatively, a pre-wet liquid supply element that is formed in a plate shape wherein the pre-wet liquid flows from one edge to the other and the side is brought into contact with the image bearing member to apply the pre-wet liquid to the surface of the image bearing member is extremely favourable.

Alternatively, the pre-wet liquid supply element may be formed in a plate shape wherein the pre-wet liquid is absorbed from one edge and the other edge is brought into contact with the image bearing member to apply the pre-wet liquid.

Note that a developing agent bearing member that has a conductive surface is desirable.

When the image bearing member is a flexible wheel-shaped photosensitive belt on the outside surface of which electrostatic latent images can be formed, a roller can be used to rotate the developing agent bearing member in accord with the direction of rotation of the image bearing member and the tension of the belt of the image bearing member can be adjusted to maintain an appropriate gap.

When the image bearing member is a drum and the developing agent bearing member is a cylindrical roller, a suitable clearance gap maintenance element can be interposed between the surfaces of both bearing members to maintain a fixed gap between the surfaces such that the pre-wet liquid film touches the developing agent film. This allows the toner to make a visible image from the electrostatic latent image that has been formed on the surface of the image bearing member.

The clearance gap maintenance element may have a protuberance of the specified height and be disposed on the periphery of both ends of either the image bearing member or the developing agent bearing member.

The preferred height of the protuberances is from 5 to 40 $\mu$m.

Alternatively, the clearance gap maintenance element may be an element shaped as a long narrow strip comprised of MYLAR® or polyimide or may be a coating of tetrafluoroethylene compound shaped as a long narrow strip.

A desirable additional provision for the liquid developing apparatus is a transfer mechanism that transfers the toner image formed on the image bearing member to a recording medium disposed on the transfer member, and that the tension of the flexible transfer member or flexible image bearing member be adjusted such that the image is transferred under the appropriate contact pressure.

The electrostatic latent image liquid developing method in this invention forms an extremely thin layer of liquid developing agent on the surface of the developing agent bearing member and abuts this to the electrostatic latent image on the surface of the image bearing member. This enables the liquid developing agent used for developing to be used at much higher concentrations than the low-concentration liquid developing agents of related art. In addition, organic solvents with unpleasant odours, such as ISOPAR G® (registered trademark), need not be used as the dielectric liquid (carrier liquid) that distributes the toner, and the volume of developing agent required is greatly reduced. As a result, copies with high resolution and good tonal reproduction can be obtained from reduced-size apparatus in an agreeable working environment from a liquid developing method.

In addition, an extremely thin layer of pre-wet liquid is formed on the surface of the image bearing member. This improves the release properties, even if the release properties of the liquid developing agent are not good due to the nature of the surface material on the image bearing member, and enables effective liquid developing.

The electrostatic latent image liquid developing method of this invention regulates the size of the minute clearance gap formed between the image bearing member and the developing agent bearing member such that the gap is larger than the thickness of the layer of liquid developing agent that is formed on the developing agent bearing member and smaller than the sum of the thicknesses of the layer of liquid developing agent that is formed on the developing agent bearing member and the layer of pre-wet liquid that is formed on the image bearing member. This allows the contact pressure to be distributed when the developing agent layer formed on the developing agent bearing member is touched to the pre-wet liquid layer formed on the image bearing member. As a result, during the developing process, the two-layer structure of the developing agent layer and the pre-wet liquid layer can be maintained when the two layers touch and, when the developing process ends, the two liquids separate at a point within the pre-wet liquid layer. This prevents the occurrence of inaccuracies in the developing agent layer and, therefore, prevents adhesion of toner to the non-image parts on the image bearing member and the occurrence of inaccuracies in the image. If the minute clearance gap between the image bearing member and the developing agent bearing member is smaller than the thickness of the liquid developing agent layer formed on the developing agent bearing member, the two-layer structure cannot be maintained, inaccuracies occur in the liquid developing agent layer, and satisfactory images cannot be obtained. If, conversely, the gap is larger than the sum of the thicknesses of the layer of liquid developing agent that is formed on the developing agent bearing member and the layer of pre-wet liquid that is formed on the image bearing member, the liquid developing agent layer and the pre-wet liquid layer do not touch and, consequently, the developing agent can no longer be supplied to the surface of the latent image on the image bearing member.

If the thickness of the pre-wet liquid layer is 30 $\mu$m or less and if the gap between the surface of the developing agent bearing member and the image bearing member surface is from 5 to 60 $\mu$m, the occurrence of inaccuracies in the developing agent layer is prevented and clear copies with very little spurious toner can be obtained, even when the material used for the photosensitive member has inadequate release properties in relation to the developing agent. Note that the manufacture of the developing agent becomes problematic due to the difficulty of stirring the dielectric liquid and the toner if the viscosity of the liquid developing agent is 10,000 mPa.s or higher. Thus, liquid developing agents with viscosities of 10,000 mPa.s or higher are not cost effective or practical. If, on the other hand, the viscosity is 100 mPa.s or lower, the concentration of the toner is low and the toner does not disperse well. As a result, developing is no longer possible with a thin layer of developing liquid. The thickness of the liquid developing agent layer can be thin when the toner concentration is high but must be thick when the toner concentration is low. In addition, the higher the viscosity, the thinner the layer must be. However, if the layer is thicker than 40 $\mu$m, excessive toner adheres, and if the layer is thinner than 5 $\mu$m, irregularities occur when solid black images are output. The optimum thickness of the pre-wet layer depends on the viscosity and surface tension of the selected pre-wet liquid. If this layer is thicker than 30 $\mu$m, the electric charge of the latent image flows, the toner spreads during development, and the image fades.

Use of a liquid developing agent that has the toner dispersed at high concentrations allows the volume of liquid required to be greatly reduced in comparison with the low-concentration liquid developing agents used in related art.

A highly viscous liquid developing agent for use with the liquid developing method of this invention can be obtained by using a dielectric liquid wherein the viscosity is from 0.5 to 1,000 mPa.s, the electric resistance is $10^{12}$ Ωcm or more, the surface tension is 21 dyn/cm or less, and the boiling point is 100° C. or more. Since the layer of liquid developing agent formed on the surface of the developing agent bearing member is thin, the liquid developing agent can contain only an extremely small amount of dielectric liquid. This means that the amount of dielectric liquid contained in the liquid developing agent that is supplied to the surface of the latent image on the image bearing member is also extremely small. Since only very small amounts of dielectric liquid are absorbed by the paper or other medium during the transfer process, the problems that can be caused by the adherence of the dielectric liquid to the paper or other medium when the viscosity is 1,000 mPa.s or less do not arise. However, the liquid becomes more highly volatile if the viscosity is reduced to 0.5 mPa.s or less. Therefore, legal restrictions related to dangerous substances apply, making the liquid unsuitable at these viscosities. If the boiling point of the dielectric liquid is reduced to 100° C. or less, higher quantities of vapour occur. This causes problems related to storage methods for the developing agent, necessitates a tightly sealed structure for the apparatus as a whole, and makes it difficult to improve the work environment. If the electric resistance is reduced to $10^{12}$ Ωcm or less, the dielectric property deteriorates. This causes toner conductivity problems which prevent use of the liquid as a developing agent. Therefore, it is desirable that the electric resistance value be as high as possible. If the surface tension is increased to 21 dyn/cm or higher, the wettability deteriorates and the intimacy of the contact with the pre-wet liquid deteriorates. Accordingly, it is desirable that the surface tension value be as low as possible.

A dielectric liquid with the above characteristics and low toxicity can be obtained if silicone oil is used as the main component.

A liquid developing agent in which the toner is dispersed at a high concentration in the dielectric liquid can be obtained by using toner with an average particle diameter of 0.1 to 5 $\mu$m at concentrations of 5 to 40% by weight of the developing agent. In addition, the resolution improves in roughly inverse proportion to the size of the toner particle diameter. Normally, the toner on the printed paper exists as aggregates of 5 to 10 grades. Thus, resolution deteriorates if the average particle diameter of the toner is increased to 5 $\mu$m or higher. If the average particle diameter of the toner is reduced to 0.1 $\mu$m or less, the physical adhesive strength increases and toner release during transfer becomes difficult.

A superior pre-wet liquid, with good release properties and good dielectric properties, has a viscosity from 0.5 to 5.0 mPa.s, an electric resistance of $10^{12}$ Ωcm or more, a surface tension of 21 dyn/cm or less, and a boiling point of 100 to 250° C. The pre-wet liquid is absorbed by the paper or other recording medium during transfer and, therefore, must be vaporised during fixing. A pre-wet liquid with a viscosity from 0.5 to 5 mPa.s is desirable due to the ease of vaporisation. If the viscosity is increased to 5 mPa.s or higher, vaporisation becomes more difficult. If the viscosity is reduced to 0.5 mPa.s or lower, the liquid becomes more highly volatile, such that legal restrictions related to dangerous substances apply, making the liquid unsuitable at these viscosities. If the boiling point is reduced to 100° C. or less, higher quantities of vapour occur. This causes problems related to storage methods for the pre-wet liquid, necessitates a tightly sealed structure for the apparatus as a whole, and makes it difficult to improve the work environment. If the boiling point is increased to 250° C. or higher, the paper curls during fixing and, therefore, the pre-wet liquid cannot be used. In addition, large amounts of energy are required for heating, which increases costs. If the electric resistance is reduced to $10^{12}$ Ωcm or less, the dielectric property deteriorates and the liquid cannot be used as a pre-wet liquid. Therefore, it is desirable that the electric resistance value be as high as possible. If the surface tension is increased to 21 dyn/cm or higher, the wettability deteriorates and the intimacy of the contact with the liquid developing agent deteriorates. Accordingly, it is desirable that the surface tension value be as low as possible.

A safe pre-wet liquid with the above characteristics can be obtained by using silicone oil as the main component.

When a pre-wet liquid supply element comprised of a liquid-permeable and liquid-retentive elastic material is used to apply the pre-wet liquid, fresh liquid can be supplied continuously as the pre-wet liquid is consumed. Or, when excessive pre-wet liquid has been applied to the surface of the image bearing member, the excess pre-wet liquid can be absorbed while the pre-wet liquid supply element is in the separated position from the image bearing member such that a layer of liquid of the appropriate thickness remains. Moreover, the pre-wet liquid supply element does not damage the surface of the image bearing member.

The above performance is exhibited particularly when the liquid is applied by a pre-wet liquid supply element that uses a sponge type of continuously porous material.

When a pre-wet liquid supply element comprising an elastic material formed as a rotating cylinder is used, fresh pre-wet liquid with a comparatively low viscosity is drawn up from the pre-wet liquid container and, when the cylinder abuts the image bearing member, the elastic deformation releases the absorbed pre-wet liquid onto the surface of the image bearing member. When the pre-wet liquid supply member is in the separated position from the image bearing member, excess pre-wet liquid is absorbed such that a layer of liquid of the appropriate thickness remains.

Alternatively, if a pre-wet liquid supply element comprising a sponge type of continuously porous material formed in a plate shape is used, the pre-wet liquid supply element can be separated from the image bearing member whenever pre-wet liquid does not need to be supplied. The pre-wet liquid supply element can be brought into contact with the image bearing member to supply the pre-wet liquid whenever pre-wet liquid application becomes necessary.

If either the transfer member or the image bearing member is flexible, the tension of the flexible bearing member can be regulated to easily maintain the appropriate contact pressure between the surfaces of the image bearing member and the transfer member.

Use of the electrostatic latent image liquid developing apparatus of this invention enables a liquid developing agent of extremely high concentration to be used for developing, in contrast with the liquid developing agent of low concentration in related art. This is because the developing agent supply mechanism forms an extremely thin film of liquid developing agent on the surface of the developing agent bearing member to supply the liquid developing agent to the electrostatic latent image on the surface of the image bearing member. This enables copies with high resolution and good tonal reproduction to be obtained from safe liquid developing apparatus of greatly reduced size.

In another liquid developing apparatus of this invention, a film of pre-wet liquid is formed on the image bearing member before the developing process is performed, and the size of the gap between the image bearing member and the developing agent bearing member is an appropriate value that is greater than the thickness of the developing agent film and smaller than the sum of the thicknesses of the developing agent film and the pre-wet film. As a result, during the developing process, the liquid developing agent film is always brought adjacent to the electrostatic latent image through the medium of the pre-wet liquid. This makes the use of a highly concentrated liquid developing agent possible for high-quality liquid developing even when the release properties of the image bearing member surface are not suitable.

When the image bearing member is a photosensitive drum and the developing agent bearing member is a flexible belt, the gap between the image bearing member and the developing agent bearing member can be easily set to the appropriate value by means of the belt tension and the reaction force with the developing agent and the pre-wet liquid.

Toner can be caused to adhere selectively to the electrostatic latent image by means of the developing agent bearing member being conductive and voltage being applied to the developing agent bearing member.

A seamless conductive belt can be obtained easily by use of nickel, allowing flawless clean copies across the entire area of the image to be obtained. Alternatively, a conductive seamless belt can be formed easily by using resin to which conductive minute particles are added or by using a polyimide film that has been treated by a conductive process on the surface of a resin belt.

The liquid-permeable and liquid-retentive elastic material that is used by the pre-wet liquid supply element to apply the pre-wet liquid can supply fresh liquid continuously as the pre-wet liquid is consumed. Or, when excessive pre-wet liquid has been applied to the surface of the image bearing member, the excess pre-wet liquid can be absorbed while the pre-wet liquid supply element is in the separated position from the image bearing member such that a film of liquid of the appropriate thickness remains. Moreover, the elastic material does not damage the surface of the image bearing member.

The above performance is exhibited particularly when a sponge type of continuously porous material is used as the pre-wet liquid supply element.

When the pre-wet liquid supply element is an elastic material formed as a rotating cylinder, fresh pre-wet liquid with a comparatively low viscosity is drawn up from the pre-wet liquid container and, when the cylinder abuts the image bearing member and the shape of the cylinder changes, the absorbed pre-wet liquid released onto the surface of the image bearing member. When the cylinder is in the separated position from the image bearing member, excess pre-wet liquid is absorbed such that a film of liquid of the appropriate thickness remains.

Alternatively, if the pre-wet liquid supply element uses a sponge type of continuously porous material formed in a plate shape, the pre-wet liquid supply element can easily supply pre-wet liquid to the surface of the image bearing member whenever necessary.

When the image bearing member is a photosensitive drum and the developing agent bearing member is a cylindrical roller, an appropriate clearance gap maintenance element is interposed between the two surfaces to maintain a fixed gap when the pre-wet liquid film and the liquid developing agent film are brought into contact. Thus, the two-layer structure is maintained and good toner images can be obtained.

When the clearance gap maintenance element has a protuberance of a fixed height, a uniform two-layer structure can be obtained easily.

Alternatively, a long narrow strip comprised of MYLAR® or polyimide or a coating of tetrafluoroethylene compound shaped as a long narrow strip can be used to provide a clearance gap maintenance element that simply and economically fulfils the intended function.

Furthermore, if either the transfer member or the image bearing member is flexible, the tension of the flexible member can be adjusted to easily provide the appropriate contact pressure for image transfer.

DESCRIPTION OF THE PREFERRED EMBODIMENTS

The first embodiment of this invention is explained below with reference to the drawings.

Figure 1:
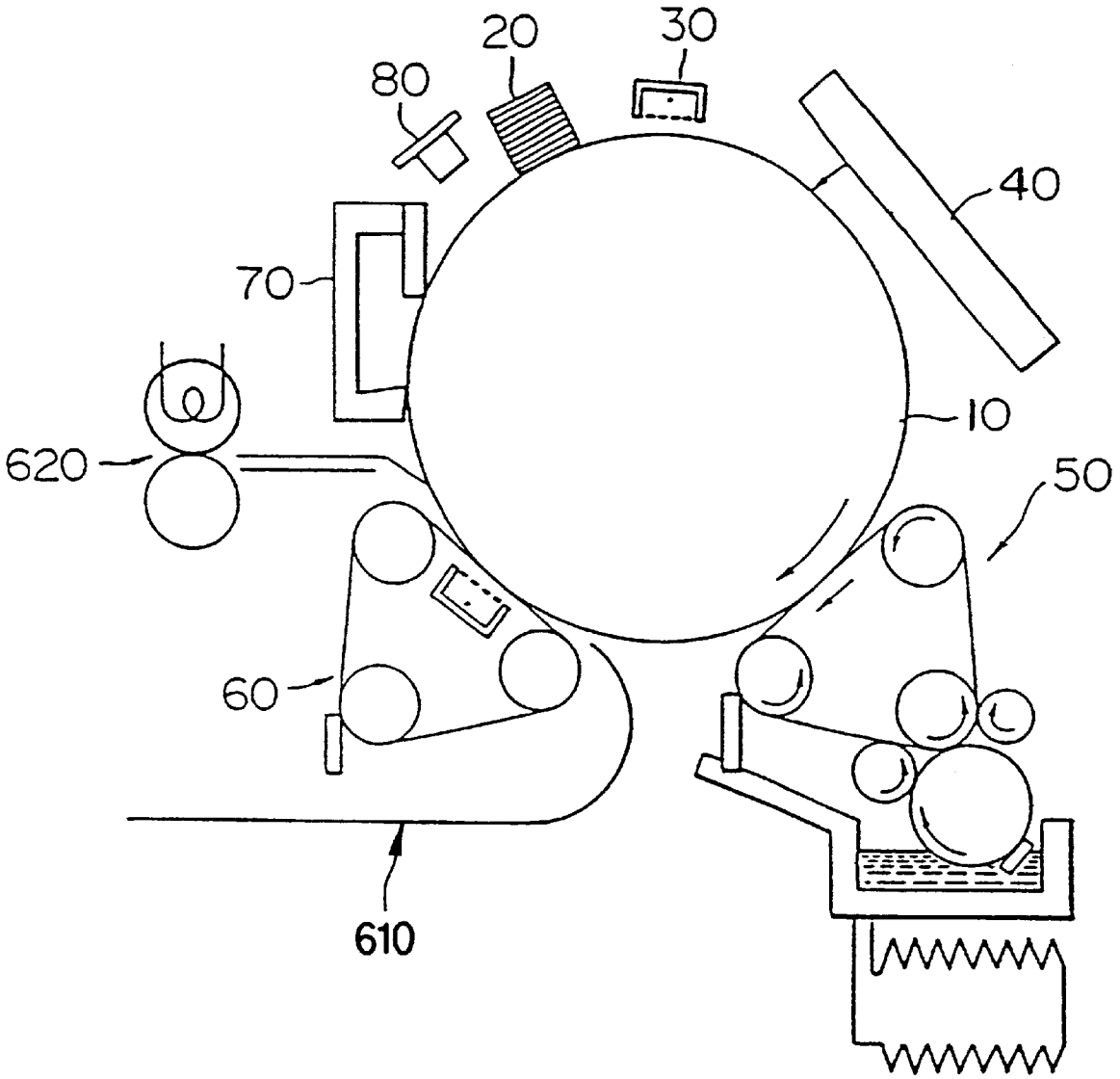
FIG. 1 is an overview of the structure of the electrostatic latent image liquid developing apparatus in the first embodiment of this invention.

The electrostatic latent image liquid developing apparatus that is the first embodiment, shown in FIG. 1, is provided with a photosensitive member 10 that is the image bearing member, pre-wet apparatus 20 that applies pre-wet liquid to the photosensitive member 10, charger apparatus 30 that gives an electric charge to the photosensitive member 10, exposure apparatus 40 that exposes the image on the photosensitive member 10, developing apparatus 50 that makes a visible image from the electrostatic latent image by means of supplying toner to the parts of the photosensitive member 10 where the electrostatic latent image is formed, transfer apparatus 60 that transfers the toner on the photosensitive member 10 to the prescribed paper, paper feed apparatus 610 that carries the prescribed paper over the transfer member in the transfer apparatus 60, fixing apparatus 620 that fixes the toner transferred from the transfer apparatus 60 to the paper, cleaning apparatus 70 that removes the remaining toner from the photosensitive member 10, and charge removal apparatus 80 that neutralises the charge on the electrically charged photosensitive member 10. The components 20, 30, 40, 50, 60, 70 and 80 are placed around the photosensitive member 10 in the order given.

The related technology used for the electrophotographic type of printers in related art can, in most cases, be used for the charger apparatus 30, exposure apparatus 40, paper feed apparatus 610, fixing apparatus 620, cleaning apparatus 70, and the charge removal apparatus 80. Accordingly, the explanation of the first embodiment omits explanations for the above types of apparatus, but explains the main parts of this invention, that is, the pre-wet apparatus 20, developing apparatus 50, and the transfer apparatus 60.

Figure 2:
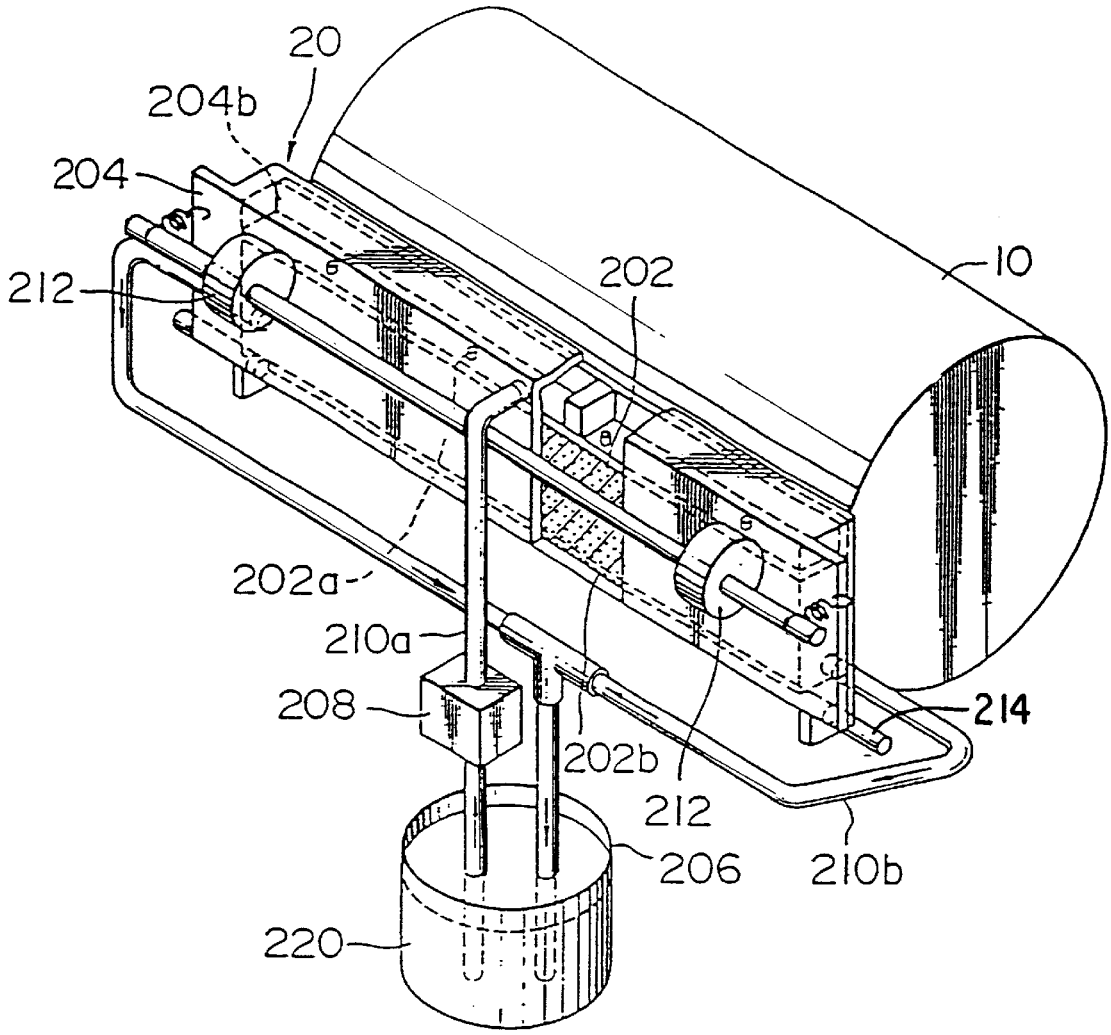
FIG. 2 is an oblique view outlining pre-wet apparatus that can be used by the electrostatic latent image liquid developing apparatus shown in FIG. 1.
Figure 3:
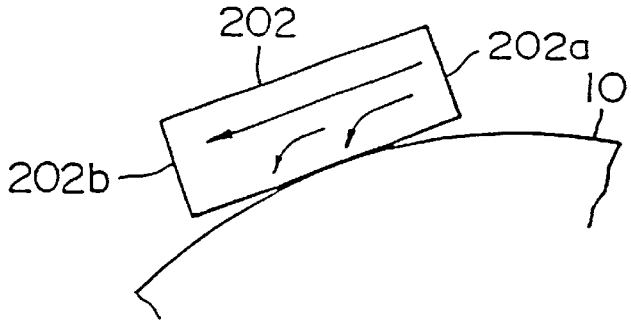
FIG. 3 shows the flow of the pre-wet liquid when the pre-wet liquid supply element is brought into contact with the photosensitive member.

The pre-wet apparatus in the first embodiment 20, shown in FIG. 2, is provided with a plate-shaped pre-wet liquid supply element 202 that is roughly as long as the width of the image created on the photosensitive member 10, a casing 204 that houses the pre-wet liquid supply element 202, a tank 206 that stores the pre-wet liquid 220, a pump 208 that draws up the pre-wet liquid 220 that is stored in the tank 206, tubes 210*a* and 210*b*, and position changing apparatus 212. A material that has a three-dimensional mesh structure in which the pores are three-dimensionally continuous, such as a continuously porous sponge or BELEETA® (Registered trademark of Kanebo, Ltd). can be used as the pre-wet liquid supply element 202. The amount of pre-wet liquid 220 that can be retained by a pre-wet liquid supply element formed from a material that has a three-dimensional mesh structure is limited to the capacity of the pores. When the supply of pre-wet liquid 220 exceeds the capacity of the pores, the pre-wet liquid 220 is released uniformly in a direction that is perpendicular to the direction of flow of the pre-wet liquid 220, as shown in FIG. 3. The side of the casing 204 that faces the photosensitive member 10 is provided with an aperture 204*a* that allows the lower side of the pre-wet liquid supply element 202 to abut the photosensitive member 10. A tube 210*a* carries the pre-wet liquid 220 that is drawn up by the pump 208 to the supply aperture 204*a* of the pre-wet liquid supply element 202. Note that an empty space 204*b* is formed between the casing 204 and the supply aperture 202*a* of the pre-wet liquid supply element 202. The pre-wet liquid 220 accumulates in this empty space 204*b* before being supplied from the supply aperture 202*a*.

Figure 4:
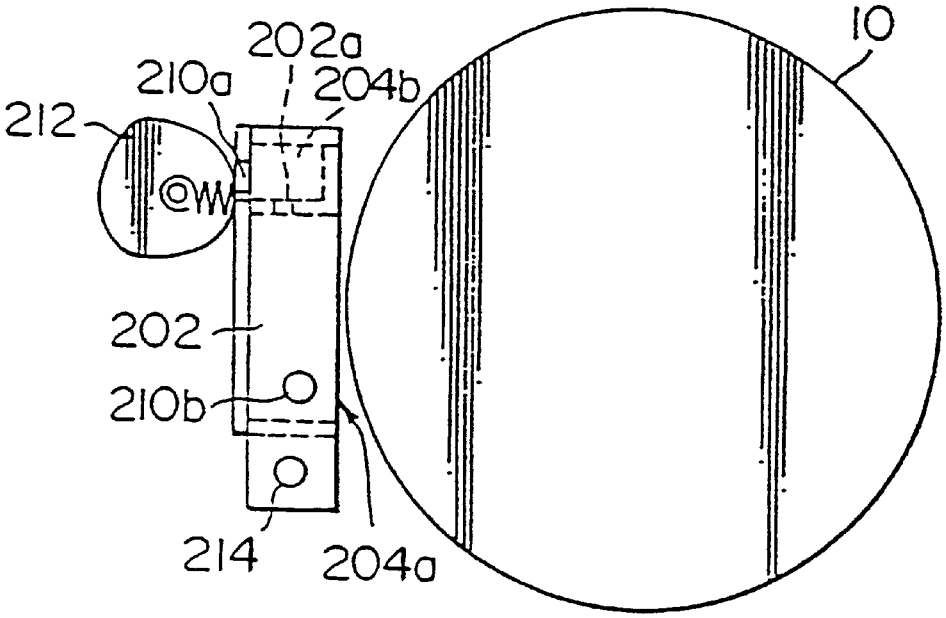
FIG. 4 shows the pre-wet apparatus shown in FIG. 2 when it is in the separated position from the photosensitive member.
Figure 5:
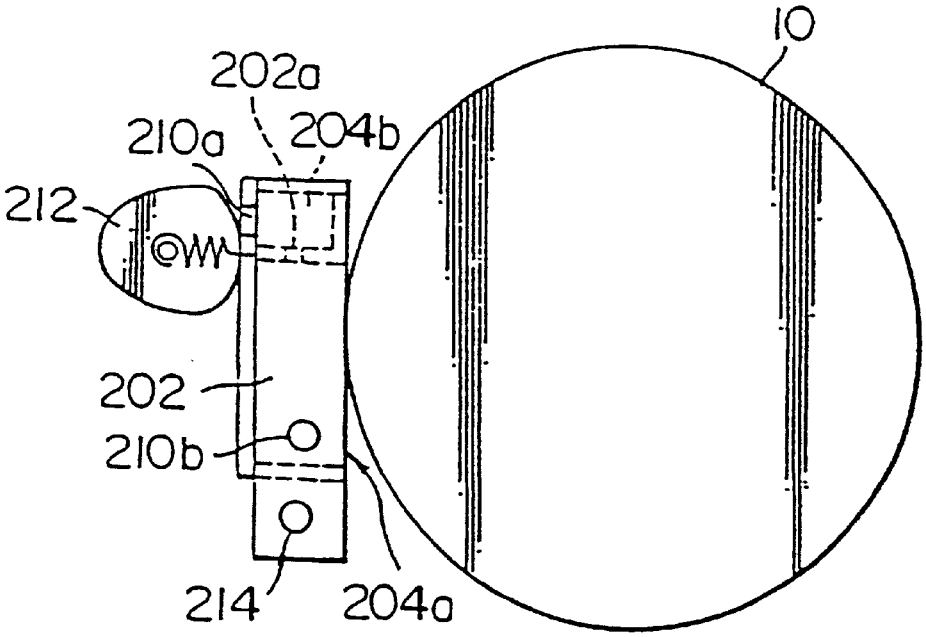
FIG. 5 shows the pre-wet apparatus shown in FIG. 2 when it is in contact with the photosensitive member.

Another tube 210*b* carries the pre-wet liquid 220 that is released from the release side 202*b* of the pre-wet liquid element 202 to the tank 206. The position changing apparatus 212 is an eccentric cam which causes the pre-wet liquid supply element to pivot on an axle 214 (FIG. 4). When an external signal is not input, the pre-wet liquid supply element 202 is held in the separated position from the photosensitive member 10, as shown in FIG. 4. When an external signal is input, the pre-wet liquid supply element 202 is brought into contact with the photosensitive member 10, as shown in FIG. 5.

Figure 6:
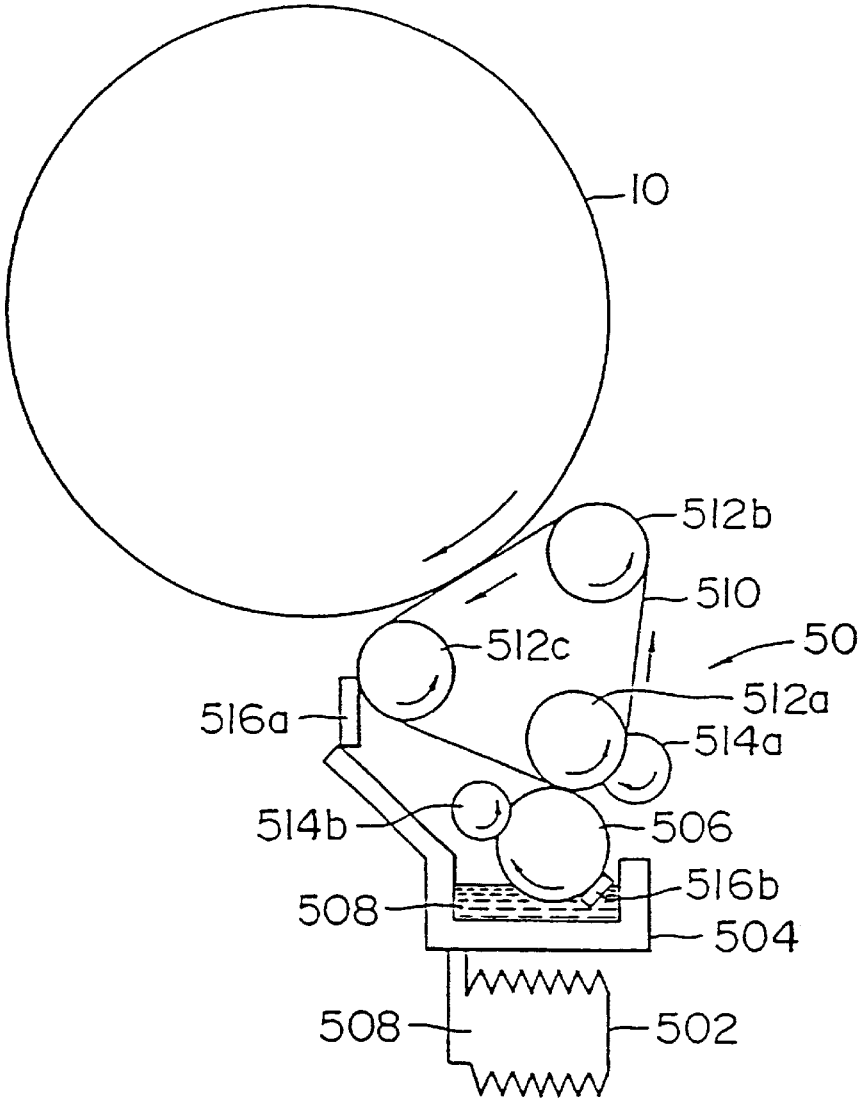
FIG. 6 is an overview of developing agent supply apparatus that can be used by the electrostatic latent image liquid developing apparatus shown in FIG. 1.

The developing apparatus 50 of the first embodiment, shown in FIG. 6, is provided with a bellows pump 502 that both stores and discharges the liquid developing agent 508, a trap 504 that holds the liquid developing agent 508 that is discharged by the bellows pump 502, a developing agent supply roller 506 disposed such that the lower part of the roller soaks in the liquid developing agent 508 that is stored in the trap 504, a developing belt 510 that is the developing agent bearing member and that is disposed on the upper part of the developing agent supply roller 506, drive rollers 512*a*, 512*b*, and 512*c* that provide the rotational drive for the developing belt 510 and also ensure that the developing belt abuts the developing agent supply roller 506 and the photosensitive member 10, regulatory rollers 514*a* and 514*b* that are formed from an elastic material and that regulate the thickness of the film of liquid developing agent 508, and scraper blades 516*a* and 516*b*.

Figure 7:
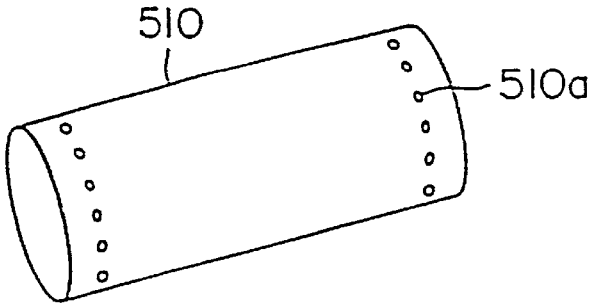
FIG. 7 is an overview of a developing belt that can be used by the developing agent supply apparatus shown in FIG. 6.

The developing agent supply roller 506 rotates in the opposite direction to the direction of rotation of the developing belt 510, as shown in FIG. 6, such that liquid developing agent 508 is carried to the surface of the developing belt 510. The use of the developing agent supply roller 506 to supply the liquid developing agent 508 to the developing belt 510 is viable because a liquid developing agent 508 in which the toner is dispersed at a high concentration is used, as described later. Thus, large quantities of developing agent are not required and, therefore, a roller is an effective means of achieving an even application of developing agent on the surface of the developing belt 510. The drive rollers 512*a*, 512*b*, and 512*c* rotate the developing belt 510 in the driven direction in relation to the photosensitive member 10, that is, in the opposite direction to the direction of rotation of the photosensitive member 10. This carries the liquid developing agent 508 supplied from the developing agent supply roller 506 to the surface of the photosensitive member 10. Perforations 510*a*, as shown in FIG. 7, are provided on both ends of the developing belt 510 and these engage the sprockets provided on both ends of a drive roller 512*a* in order to apply a rotational drive force to the developing belt 510. As a result, the developing belt 510 can be stabilised and driven.

A flexible element is used as the developing belt 510. The rigidity of the developing belt is a factor in maintaining the two-layer structure of the developing agent film formed on the developing belt 510 and the pre-wet liquid film formed on the photosensitive member 10 when the two layers touch and also in the two layers being separated at a point within the pre-wet liquid layer. Experiments performed by the inventors et al. showed that, when a seamless nickel belt is used as the developing belt 510, the rigidity of the developing belt is related to the peripheral length and the thickness of the developing belt. Good results can be obtained when the peripheral length of the developing belt is 125 mm and the thickness is 30 $\mu$m, or when the peripheral length of the developing belt is 250 mm and the thickness is 50 $\mu$m. When a seamless resin belt, such as a polyimide film belt, is used as the developing belt 510, the rigidity of the developing belt is not affected by the peripheral length or thickness of the developing belt and good results can be obtained. Note that resin belts require the addition of conductive minute particles to lower the electric resistance value such that a developing bias can be applied or, alternatively, a conductive process must be applied to the surface of the belt.

Figure 8:
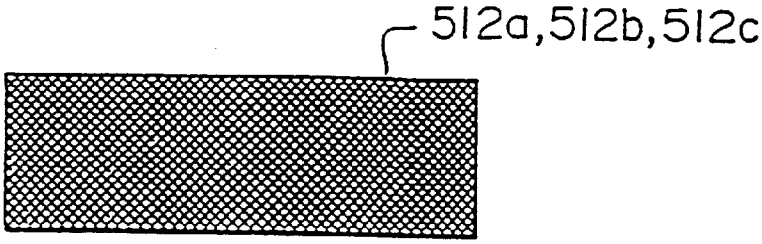
FIG. 8 shows the surface pattern on a modified example of the drive roller that can be used by the developing agent supply apparatus shown in FIG. 6.

Rubber rollers to which minute conductive particles are added to provide a low electric resistance value, so that a developing bias can be applied, are used for the drive rollers 512*a*, 512*b*, and 512*c*. In addition, grid patterns are provided on the surfaces of the drive rollers 512*a*, 512*b*, and 512*c*, as shown in FIG. 8, to prevent slippage of the developing belt 510. Regulatory roller 514*a* is disposed such that it presses against the developing belt 510 wound on drive roller 512*a* and rotates in the direction that drives the developing belt 510, that is, in the direction that drives the drive roller 512*a*. Regulatory roller 514*b* is disposed such that it presses against the developing agent supply roller 506 and rotates in the direction that drives the developing agent supply roller 506. Note that experiments performed by the inventors et al. showed that good results can be obtained in terms of the formation of a thin layer of liquid developing agent 508 on the developing belt 510 if the peripheral speed of regulatory roller 514*a* is twice as fast as the peripheral speed of the developing belt 510. Scraper blades 516*a* and 516*b* scrape off the liquid developing agent 508 that has adhered to the developing belt 510 and to the developing agent supply roller 506 respectively.

Figure 9:
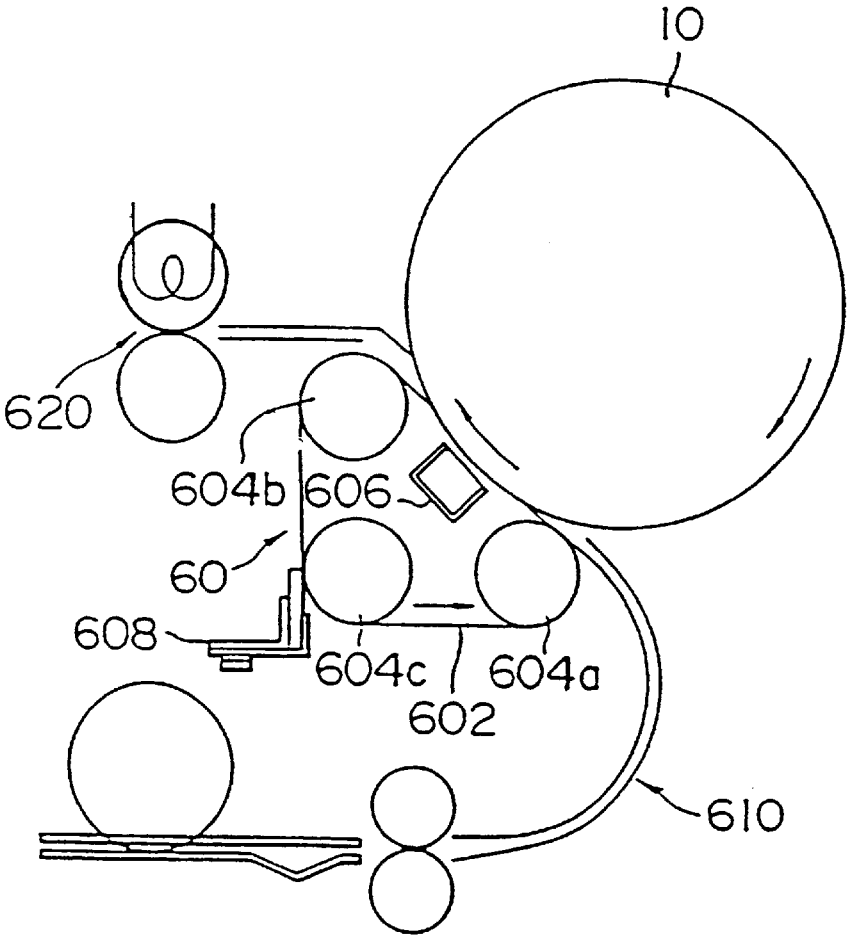
FIG. 9 is an overview of the structure of image formation apparatus that can be used by the liquid developing apparatus in this invention.

The transfer apparatus 60 of the first embodiment, shown in FIG. 9, is provided with a transfer belt 602 that is the transfer member, drive rollers 604*a*, 604*b*, and 604*c* that provide the rotational driving force for the transfer belt 602 and that also support the transfer belt 602 such that part of the transfer belt abuts the photosensitive member 10, a corona discharge device 606 that charges the transfer belt 602 with an electric charge of opposite polarity to the toner, and a scraper blade 608 that scrapes off the toner that has adhered to the transfer belt 602.

The drive rollers 604*a*, 604*b*, and 604*c* rotate the transfer belt 602 in the opposite direction to the direction of rotation of the photosensitive member 10. As a result, the paper carried by the paper feed apparatus 610 is fed between the photosensitive member 10 and the transfer belt 602. A flexible element such as a rubber belt, a seamless nickel belt coated with a resistance layer on the surface, or a resin belt is used for the transfer belt 602. The flexibility allows the contact pressure to be distributed when the toner image formed on the photosensitive member 10 and the paper touch.

A value of from $10^4$ to $10^{11}$ Ωcm is desirable as the electric resistance value of the transfer belt 602. If the electric resistance value is $10^4$ Ωcm or less, there is a possibility that the paper fed between the photosensitive member 10 and the transfer belt 602 may also become charged by the corona discharge device 606. Since the resistance value of the paper varies greatly $10^9$ to $10^{13}$ Ωcm in accordance with the paper type and the humidity, if the charge does reach the paper, the change in the resistance value of the paper inappropriately affects the transfer to the paper of the toner image formed on the photosensitive member 10. If the electric resistance value is increased to $10^{11}$ Ωcm or higher, the charge on the transfer belt 602 becomes too small, the electrostatic force between the transfer belt 602 and the toner image formed on the photosensitive member 10 becomes too weak, and insufficient toner is transferred to the paper. Note that, to achieve the above electric resistance values for the transfer belt 602 when a resin belt is used, minute conductive particles must be added or a conductive process must be applied to the surface.

A fluorine coating is applied to the surface of the transfer belt 602. This prevents the transfer belt 602 from becoming dirty because it improves the transfer belt's release properties in relation to the toner and makes it easier for the scraper blade 608 to scrape off the toner adhering to the transfer belt 602.

The image formation raw materials used in the first embodiment are explained next. The liquid developing agent 508 used in the first embodiment is comprised of toner and a carrier liquid. The toner is comprised of a an epoxy or similar resin as a binder, an electric charge control agent that gives a specific charge to the toner, colour pigment, a dispersing agent that disperses the toner evenly, and so on. The composition of the toner is basically the same as the toner used in the liquid developing agents in the related art, but the formulae for the regulation of the electric charge characteristics and dispersion have been changed to suit silicon oil. If the average particle diameter of the toner is reduced, the resolution improves but the physical adhesive force also increases. This makes the toner difficult to release during transfer. Therefore, the average particle diameter of the toner used in the first embodiment is regulated such that most particles are about 2 to 4 $\mu$m in order to improve ease of transfer.

The viscosity of the liquid developing agent is determined by the types and concentrations of the carrier liquid, resin, colour pigment, electric charge control agent, and other components that are used. For the first embodiment, various viscosities in the range from 50 to 600 mPa.s and various toner concentrations in the range from 5 to 40% were tested.

A liquid with high electric resistance and low viscosity, such as dimethyl polysiloxane oil or a cyclic polydimethylsiloxane oil, is used as the carrier liquid. Note that, since the layer of liquid developing agent formed on the developing agent bearing member is formed as a thin film, the carrier liquid contained in the layer of liquid developing agent is only an extremely small amount. Therefore, the amount of carrier liquid included in the layer of liquid developing agent supplied to the surface of the latent image on the photosensitive member 10 is also extremely small. As a result, only extremely small amounts of carrier liquid are absorbed by the paper or other recording medium during transfer. Therefore, if the viscosity is 1,000 mPa.s or less, remaining carrier liquid usually cannot be seen on the paper or other recording medium after fusing. Experiments performed by the inventors et al. showed that, after fusing, remaining carrier liquid could not be seen on the paper or other recording medium when either DC344 from Dow Corning Corporation of America with a viscosity of 2.5 mPa.s or DC345 from Dow Corning Corporation of America with a viscosity of 6.5 mPa.s were used as the carrier liquid for the image output tests. However, the developing apparatus must have a tightly sealed structure due to the high volatility of these liquids. Further image output tests were performed using KF-96-20 from Shin-Etsu Silicone Co., Ltd. with a viscosity of 20 mPa.s as the carrier liquid. After fusing, remaining carrier liquid could not be seen on the paper or other recording medium and, furthermore, the volatility is low enough that the developing apparatus does not need a tightly sealed structure. DC344, DC345, and KF-96-20 are all in general use in cosmetic products, have low toxicity, and are extremely safe. There are many types of similar carrier liquids containing silicone oil or similar components, including KF9937, from Shin-Etsu Silicone Co., Ltd. Any of these may be selected as long as they meet the electric resistance, vapour characteristic, surface tension, safety, and other requirements.

Experiments performed by the inventors et al. showed that fogging and adhesion of clusters of toner can occur if the surface tension is too high. Experiments showed that image quality problems occur if the surface tension is 21 dyn/cm or higher.

To avoid stability problems with the electric charge of the toner, an electric resistance value of $10^{14}$ Ωcm or more is desirable and a minimum value of $10^{12}$ Ωcm or more is required. In keeping with the results of these experiments, an example using DC345, which is inexpensive and easy to obtain, is given in the explanation of the first embodiment.

A liquid which does not cause inaccuracies in the electrostatic latent image formed on the image bearing member, that vaporises easily during fusing, and that does not cause fogging or adhesion of clusters of toner is required as the pre-wet liquid. Examples include DC344, DC200-0.65, DC200-1.0, and DC200-2.0 from Dow Corning Corporation of America and KF96L-1 and KF9937 from Shin-Etsu Silicone Co., Ltd. Generally, a silicone oil that vaporises easily must be selected.

Experiments performed by the inventors et al. showed that developing, transfer, and fusing dries the liquid without any problems occurring if the viscosity of the liquid is in the range from 0.5 to 3 mPa.s. However, with viscosities from about 5 to 6 mPa.s, both time and heat tend to be required to dry the liquid during fusing. A viscosity of 10 mPa.s is not normally used because too much energy is required for drying. If the viscosity is reduced 0.5 mPa.s or less, the liquid becomes more volatile and is not suitable due to the legal constraints as a dangerous substance that apply. In addition, a liquid with a boiling point of 250° C. or less must be used because the paper is affected by application of heat.

The surface tension should be as low as possible in order to avoid an adhesive force between the developing agent and the image bearing member, to prevent the image becoming dirty or foggy, and to improve the resolution in the image quality. Experiments performed by the inventors et al. showed that the limit is about 20 to 21 dyn/cm and that a value below this must be selected.

If the electric resistance is too low, the charge of the latent image leaks and the image fades. Therefore, a liquid with an electric resistance that is as high as possible must be used. Experiments showed that an electric resistance of about $10^{14}$ Ωcm or more is desirable and a minimum value of $10^{12}$ Ωcm is required.

FIG. 10 explains the operation of the first embodiment of the liquid developing apparatus used for developing electrostatic latent images. Firstly, as shown in FIG. 10A, the pre-wet apparatus 20 applies the above pre-wet liquid 220 to the photosensitive member 10. When an external signal is input, the pre-wet apparatus 20 moves the pre-wet liquid supply element 202 into contact with the photosensitive member 10. The pre-wet liquid 220 is circulated continuously inside the pre-wet liquid supply element 202 by means of the pump 208. Pre-wet liquid 220 that exceeds the capacity of the pores in the BELEETA used as the pre-wet liquid supply element 202 is released from the release side 202*b* of the pre-wet liquid supply element 202, as shown in FIG. 3, and also from the lower surface of the pre-wet liquid supply element 202. This provides a uniform application of the pre-wet liquid to the photosensitive member 10 without causing damage to the photosensitive member 10.

Figure 10A:
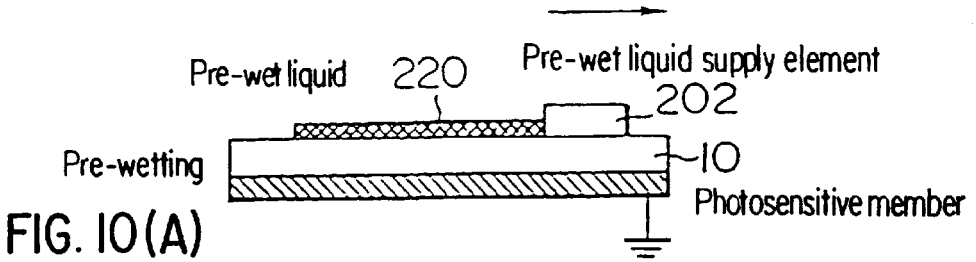
FIG. 10 explains the operation of the electrostatic latent image liquid developing apparatus shown in FIG. 1.
Figure 10B:
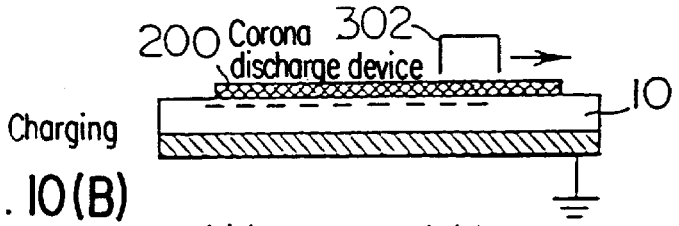
Figure 10C:
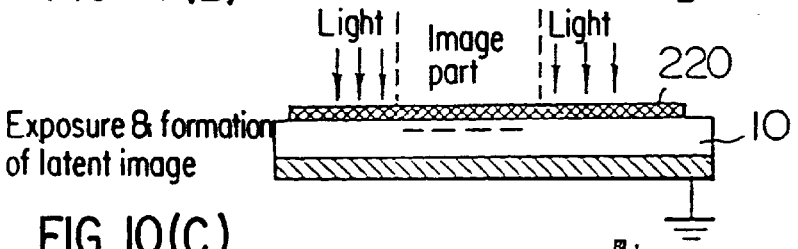

Next, as shown in FIG. 10B, the photosensitive member 10 to which pre-wet liquid 220 has been applied is given an electric charge by the corona discharge device 302. The electric charge is carried by ions which reach the surface of the photosensitive member 10 through the medium of the pre-wet liquid 202 layer. Then, the image is exposed on the photosensitive member 10. A laser scanner, for example, exposes the image and forms an electrostatic latent image on the surface of the photosensitive member 10. As shown in FIG. 10C, the parts that are hit by the light from the laser scanner are made conductive and the electric charge dissipates. The parts that have been hit by the light are the charged image and remain as the electrostatic latent image.

Figure 10D:
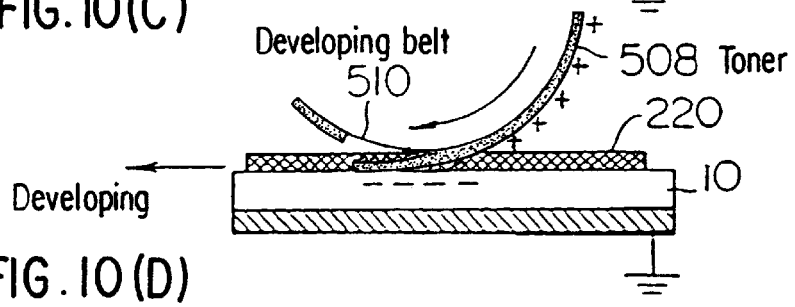

Next, the developing apparatus 50 makes the electrostatic latent image into a visible image. The liquid developing agent 508 that has been discharged from the bellows pump 502 and stored in the trap 504 is drawn up by the developing agent supply roller 506, the thickness of the layer is adjusted by regulatory roller 514*b*, and then the liquid is supplied to the developing belt 510. The thickness of the layer of liquid developing agent 508 supplied to the developing belt 510 is adjusted by regulatory roller 514*a* to form a thin film on the developing belt 510. The liquid developing agent film formed on the developing belt 510 in this way is brought adjacent to the electrostatic latent image formed on the surface of the photosensitive member 10, as shown in FIG. 10D, where the electrostatic force transfers the charged toner to the photosensitive member 10. Note that the liquid developing agent 508 that is stored in the trap 504 is agitated by the rotation of the developing agent supply roller 506.

Figure 10E:
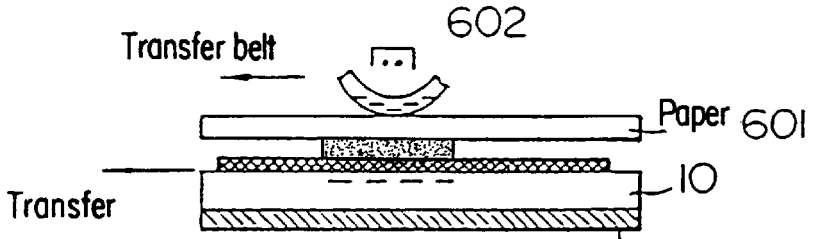
Figure 10F:
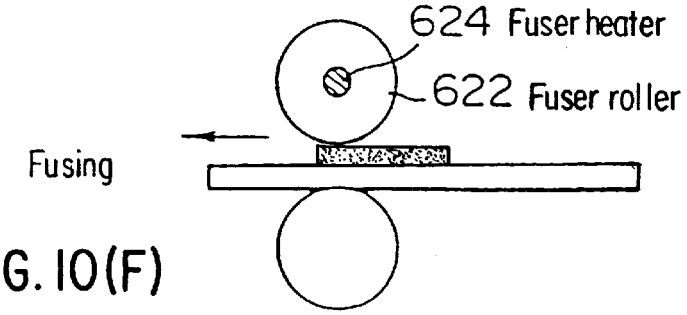

Next, the toner image that has been formed on the photosensitive member 10 is transferred to the paper recording medium by the transfer apparatus 60. An electrostatic force is generated between the toner image that has been formed on the photosensitive member 10 and the transfer belt 602 that the corona discharge device 606 has charged with an electric charge that has the opposite polarity to the toner. As shown in FIG. 10E, this electrostatic force makes the toner adhere to the surface of the paper that has been carried by the paper feed apparatus 610 and fed between the photosensitive member 10 and the transfer belt 602. In this way, the image formed on the photosensitive member 10 is transferred to the paper. Then, as shown in FIG. 10F, the heater 624 that is provided within the fuser roller 622 of the fusing apparatus 620 thermally fuses the transferred toner and fixes it to the paper. The cleaning apparatus 70 removes the liquid developing agent 508 that remains on the photosensitive member 10. Then, after the charge removal apparatus 80 neutralises the charge on the photosensitive member 10, the photosensitive member can be used again repeatedly for the above cycle from electric charging through to charge neutralisation.

FIGS. 11 to 19 explain the details of the developing process in the first embodiment.

Figure 11:
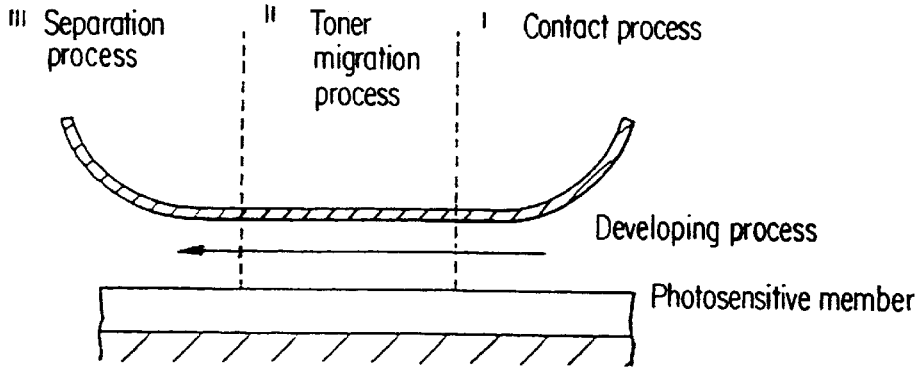
FIG. 11 explains the developing process.

The developing process of the first embodiment can be thought of as consisting of the following three processes, as shown in FIG. 11: the contact process in which the developing belt comes close to the photosensitive member and the liquid developing agent comes close to the surface of the photosensitive member; the toner migration process in which the liquid developing agent layer and the pre-wet layer make soft contact, allowing the toner to migrate; and the separation process in which the developing belt separates from the photosensitive member, and the toner adhering to the developing belt separates from the toner adhering to the photosensitive member.

Figure 12:
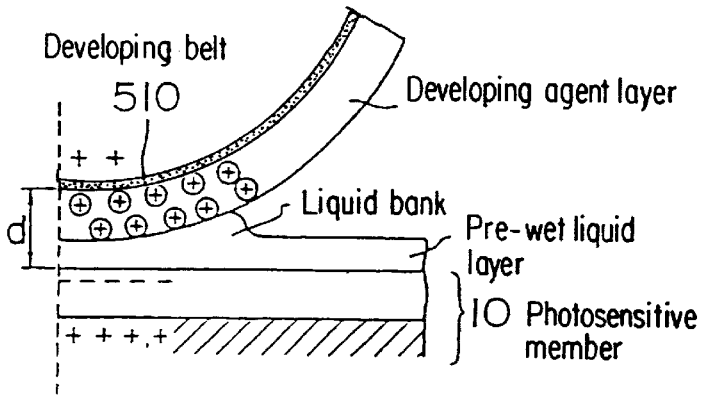
FIG. 12 shows details of the contact process during the developing process.

The developing belt 510 is constructed from a flexible element. This allows a minute gap d to be formed between the developing belt and the photosensitive member during the contact process, as shown in FIG. 12, and the highly viscous liquid developing agent, comprised of a carrier liquid and toner, and the pre-wet liquid form a soft contact. This contact pushes out some of the pre-wet liquid, which has the lower viscosity of the two liquids, and produces a liquid bank of pre-wet liquid. The condition wherein the above gap is formed does not refer to the deliberate formation of a fixed gap between the image bearing member and the developing agent bearing member, but rather to the condition wherein the two-layer structure of the developing agent layer on the developing agent bearing member and the pre-wet layer on the image bearing member is maintained so that inaccuracies do not occur.

Figure 13:
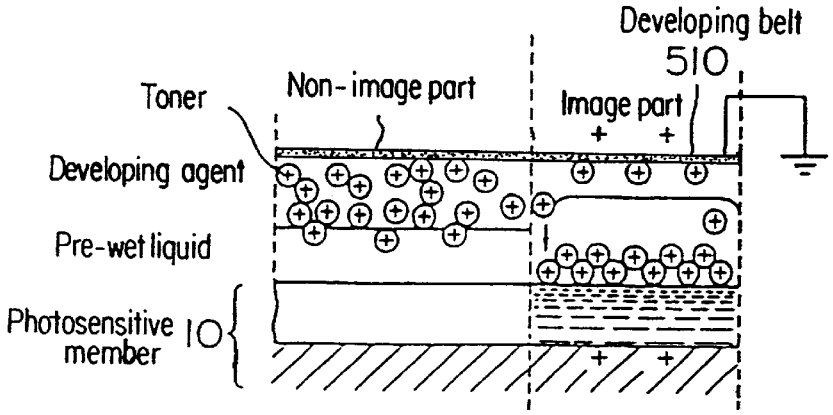
FIG. 13 shows details of the toner migration process during the developing process.

During the toner migration process, the electrical field formed between the electric charge on the photosensitive member 10 and the developing belt 510 causes the toner at the image parts to migrate, as shown in FIG. 13, to the latent image surface through the medium of the pre-wet liquid layer, mainly by means of the Coulomb force. At the non-image parts, the surface of the photosensitive member 10 and the liquid developing agent layer are basically separated by the pre-wet liquid layer and, therefore, the toner does not adhere to the photosensitive member 10.

Figure 14:
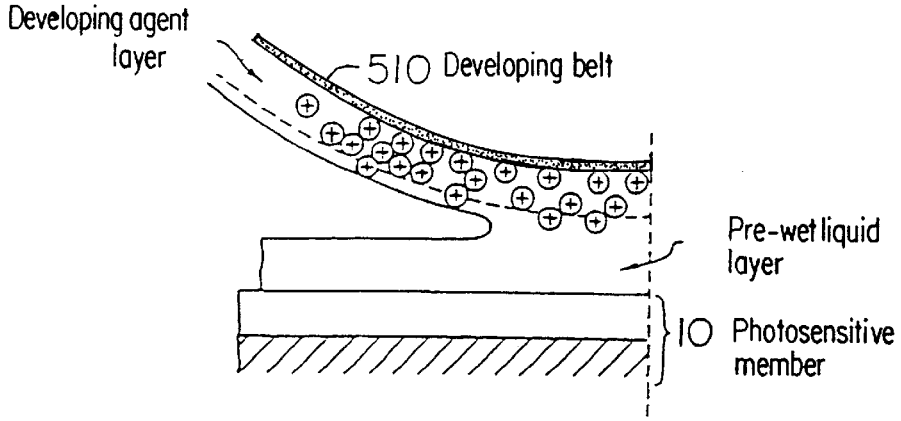
FIG. 14 shows the separation process at the non-image parts during the developing process.
Figure 15:
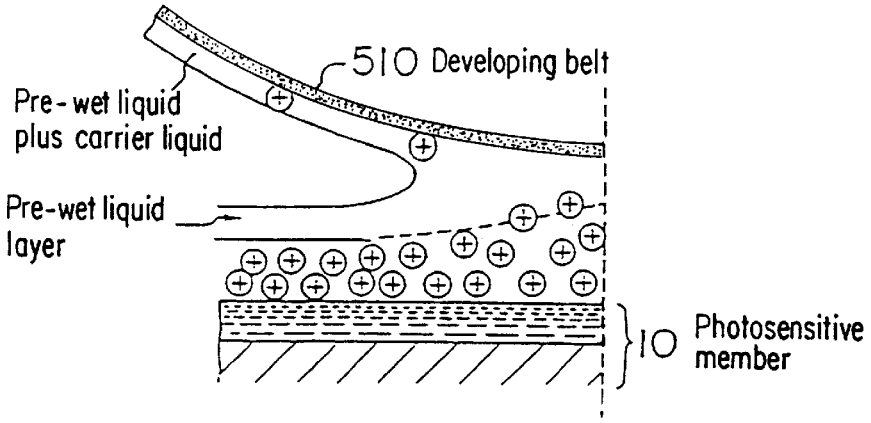
FIG. 15 shows the separation process at the image parts during the developing process.

During the separation process, the liquid developing agent basically remains on the developing belt 510 at the non-image parts, as shown in FIG. 14. When the pre-wet liquid layer and the liquid developing agent layer separate at their interface into two layers, part of the pre-wet liquid layer, which has the lower viscosity, is transferred to the liquid developing agent layer to achieve the separation. Accordingly, the separation point for the two layers can be seen as being a point within the pre-wet liquid layer. At the image parts, the toner that has migrated to the surface of the photosensitive member 10 pushes the pre-wet liquid layer away such that the pre-wet liquid layer is located on top of the toner layer and the separation is made at a point within that pre-wet liquid layer, as shown in FIG. 15. Some of the carrier liquid that remains on the developing belt 510 after the toner has migrated and some of the pre-wet liquid form a thin film layer. The pre-wet liquid remaining on the photosensitive member 10 can be moved easily during the subsequent transfer process by the electrostatic force of the toner.

Figure 16:
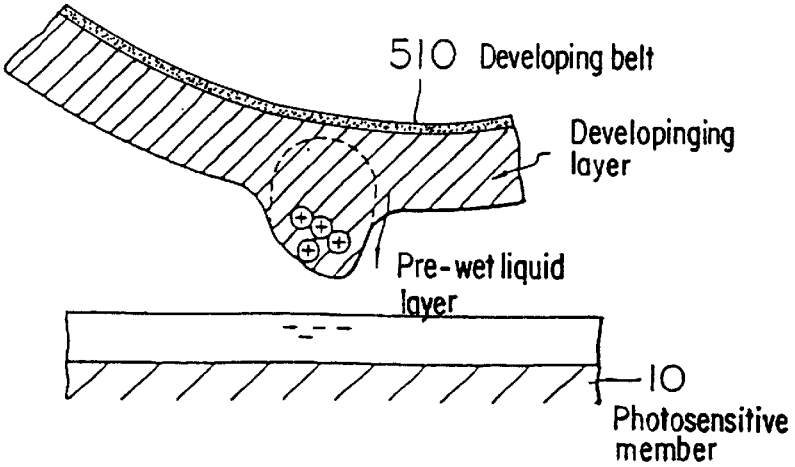
FIG. 16 explains the significance of providing a thin layer of liquid developing agent.

FIG. 16 explains the significance of the liquid developing agent being in the form of a thin film. If the layer of liquid developing agent applied to the developing belt 510 is too thick, the high viscosity of the liquid developing agent 508 causes excessive toner adherence, which produces image noise. This is because, when the electrostatic force moves a toner selection from the developing belt 510 to the surface of the photosensitive member 10, the surrounding toner adheres to the toner selection to form a cluster which moves to the photosensitive member 10 along with the target toner selection. If the layer is too thin, clusters do not form but a uniform distribution of toner over the entire roller becomes difficult to achieve. Therefore, the value for the minimum thickness of the liquid developing agent layer that provides good developing results must be determined.

Figure 17:
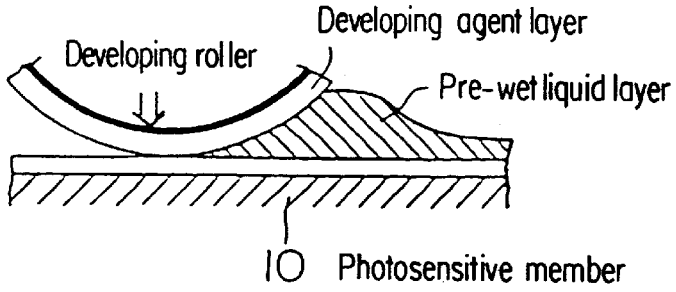
FIG. 17 shows hard contact between a developing roller and a photosensitive member.
Figure 18:
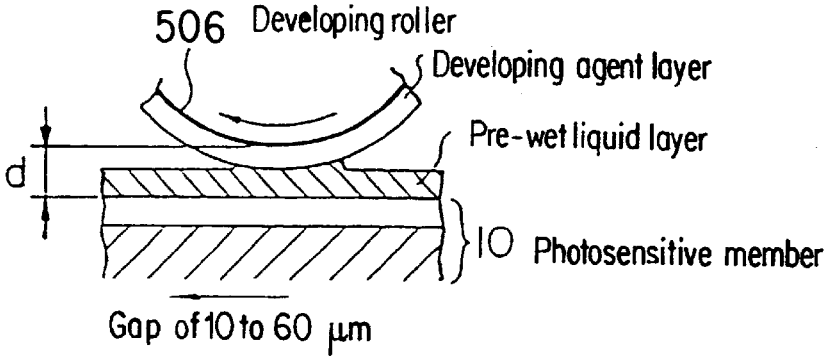
FIG. 18 explains the soft contact achieved by the developing roller in the liquid developing apparatus of this invention.
Figure 19:
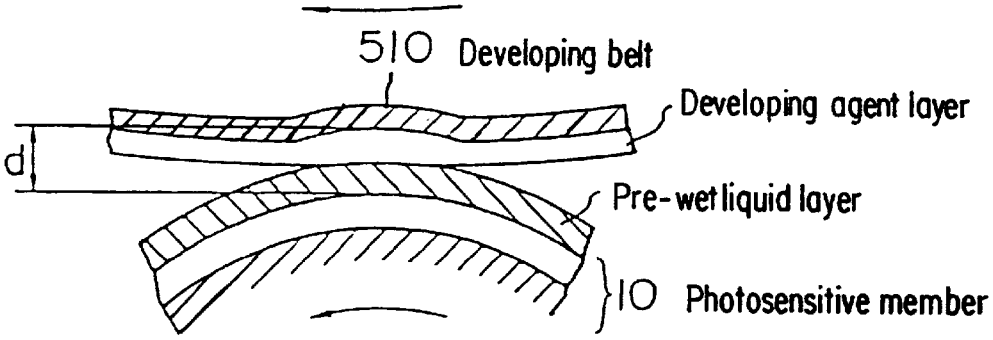
FIG. 19 explains the soft contact achieved by the developing belt in the liquid developing apparatus of this invention.

FIG. 17 shows how hard contact is made between a developing roller that is a developing agent bearing member and a photosensitive member, and FIG. 18 explains the soft contact achieved in the first embodiment. As explained above, the function of the pre-wet liquid layer during the developing process is of major importance to image formation in the first embodiment. Accordingly, maintenance of the two-layer structure of the pre-wet liquid layer and the liquid developing agent layer is an important pre-condition of the developing process. If the developing roller and the photosensitive member are brought into hard contact as shown in FIG. 17, the low-viscosity pre-wet liquid layer is expelled and the two-layer structure cannot be maintained. Therefore, the photosensitive member 10 and the developing roller 506 must be positioned such that a minute gap, gap d in FIG. 18, is provided between the surface of the photosensitive member 10 on which the electrostatic latent image is formed and the developing roller 506. FIG. 19 shows a method used in the first embodiment to provide this minute gap. Instead of the developing roller 506, a developing belt 510 that is constructed from a flexible element is used as a belt element. This element allows the minute gap d to form between the surface of the photosensitive member 10 on which the electrostatic latent image is formed and the developing belt 510. Use of a flexible element for either the photosensitive member or the developing agent bearing member in this way has the advantages of allowing relaxation of mechanical precision requirements and enabling easy assembly.

Next, optimization of the toner layer thickness, pre-wet layer thickness, and the developing gap is explained. The toner layer must be thin if the viscosity of the liquid developing agent is 50 to 100 mPa.s or higher, and particularly so if the viscosity is 500 mPa.s or higher. The ideal layer thickness is just a little thicker than the layer thickness that can supply the toner developing capacity that is, the concentration when solid black is output required during developing. This is because a highly viscous liquid developing agent is used and, if the layer is too thick, the electrostatically selected toner brings neighbouring toner along with it when migrating to the photosensitive member during developing due to the viscosity of the liquid. This results in the adhesion of superfluous toner and causes images to become dirty. The experiments performed by the inventors et al. concerning developing agents with high toner concentrations showed that good images can be obtained using layer thicknesses starting from 5 $\mu$m, and up to about 40 $\mu$m for comparatively lower toner concentrations. In addition, if a developing agent with a toner concentration of 20 to 30% is used, good image quality can be obtained using toner layer thicknesses of about 8 to 20 $\mu$m.

The optimum value for the thickness of the pre-wet liquid layer depends on the viscosity and surface tension of the selected pre-wet liquid. If the layer is too thin, developing agent at non-image parts adheres to the photosensitive member. In addition, at the image parts, the release between the developing agent layer and the developing belt is not adequate and the highly viscous liquid developing agent adheres to the photosensitive member in a disorderly manner, which causes images to become dirty. The layer being too thin can be confirmed if the images become cleaner as the quantity of pre-wet liquid is increased. The improvement results from the toner adhering less easily to the non-image parts on the image bearing member after release if the pre-wet liquid layer between the developing agent layer at the non-image parts and the photosensitive member is made thicker. As the quantity of pre-wet liquid is increased even further, the latent image electric charge flows causing the clarity and resolution to deteriorate, the toner spreads during developing, and the image tends to fade. Accordingly, optimum values for the thickness of the pre-wet layer vary in accordance with the other conditions. In experiments in which DC344 was used, good results were obtained with thicknesses of 5 to 30 μm, and even better results with thicknesses of 20 μm or less. With liquids with even lower viscosities, good results can be obtained with both thinner and thicker layers. However, the range of optimum values tends to become narrower with more highly viscous liquids.

As with the developing methods in related art, the image quality attributes of resolution and the uniformity of the density in solid parts improves as the gap between the photosensitive member and the developing belt is made smaller. When powder developing agents are used, the toner to be used for developing is freed from the developing agent bearing member or carrier particles by mechanical impact and electrostatic force. However, in the highly viscous liquid developing agent used in the first embodiment, the adhesive force between the toner particles is too strong to allow use of this type of developing. In other words, developing does not take place through the medium of an air space between the developing agent layer and the photosensitive member. Rather, the contact between the developing belt and liquid developing agent layer, the liquid developing agent layer and the pre-wet layer, and the pre-wet layer and the photosensitive member is mandatory. Therefore, before developing starts, the gap must be no larger than the gap required to accommodate the pre-wet layer on the surface of the photosensitive member. Accordingly, the size of developing gap d must be larger than the thickness of the developing agent layer and smaller than the sum of the thicknesses of the developing agent layer and the pre-wet layer, that is, from about 10 to 60 μm. Table 1 shows the relationships that can be predicted between the thickness of the developing agent layer, the thickness of the pre-wet liquid layer, and developing gap d. The inventors et al. performed experiments in which a roller was used as either the developing agent bearing body or the image bearing body in order to find the exact values for the above gap.

The experimental results verified the relationships shown in Table 1 at the following test values: a developing agent layer thickness of 10 μm with pre-wet liquid layer thicknesses of 20 μm and 30 μm; a developing agent layer thickness of 20 μm with pre-wet liquid layer thicknesses of 10 μm, 20 μm, and 30 μm; and developing gap d values of 20 μm, 30 μm, 40 μm, 50 μm, and 60 μm for each of the above combinations.

TABLE 1

| Layer thickness | | Development Gap (μm) | | | | | | | |
|---|---|---|---|---|---|---|---|---|---|
| Developing agent layer | Pre-wet liquid layer | 5 | 10 | 20 | 30 | 40 | 50 | 60 | 70 |
| 5 | 5 | Developing agent disturbed; good images not obtainable | Soft contact good images obtainable | | | | | | |
| 5 | 10 | | | | | | | | |
| 5 | 20 | | | | | | | | |
| 5 | 30 | | | | | | | | |
| 10 | 5 | | | Soft contact good images obtainable | | | | | |
| 10 | 10 | | | | | | | | |
| 10 | 20 | | | | | | | | |
| 10 | 30 | | | | | | | | |
| 20 | 5 | | | | No contact; images not possible | | | | |
| 20 | 10 | | | | | | | | |
| 20 | 20 | | | | | | | | |
| 20 | 30 | | | | | | | | |
| 30 | 5 | | | | Soft contact good images obtainable | | | | |
| 30 | 10 | | | | | | | | |
| 30 | 20 | | | | | | | | |
| 30 | 30 | | | | | | | | |
| 40 | 5 | | | | | | Soft contact good images obtainable | | |
| 40 | 10 | | | | | | | | |
| 40 | 20 | | | | | | | | |
| 40 | 30 | | | | | | | | |

In the first embodiment, the developing gap d is set at values between 20 μm and 50 μm, as appropriate, to suit differences in the viscosity of the developing agent and toner concentration.

Table 2 shows the results of image output experiments performed under the above conditions. These results indicate that the most suitable viscosity ranges for the developing agent and the pre-wet liquid in the developing method of the first embodiment are developing agent viscosity values of 100 mPa.s or higher and pre-wet liquid viscosity values from 0.5 to 5 mPa.s. The image quality is affected by the thickness of the layer of liquid developing agent on the developing belt, the thickness of the pre-wet liquid layer, the developing agent gap, and other factors, but even if the various developing conditions are optimised, the general trends shown in Table 1 apply, and the test results confirm that the optimum characteristics for the liquid developing agent are within the range shown in Table 1. The Dow Corning DC200 series was used as the pre-wet liquid silicone oil, and Dow Corning DC345 was used as the carrier liquid in the developing agent.

TABLE 2

| | | Viscosity of developing agent | | | | |
|---|---|---|---|---|---|---|
| | Toner concentration | Viscosity of pre-wet liquid mPa · s | | | | |
| mPa · s | % | 0.65 | 1.5 | 3.0 | 5.0 | 10 |
| 50 | 5 | Image density tends to be low, and the uniformity of the toner distribution deteriorates slightly | | | | Vaporisation of oil remaining on the paper is too slow to be practical |
| 100 | 10 | Density tends to be slightly low | | Vaporisation of oil remaining on the paper is slow practical limit | | |
| 500 | 20 | Good quality images both density and resolution can be obtained | | | | |
| 1,000 | 22 | | | | | |
| 2,000 | 25 | | | | | |
| 3,000 | 30 | | | | | |
| 6,000 | 40 | | | | | |

Under current conditions, highly viscous developing agents with viscosities of 6,000 mPa.s or higher are not really practical due to the difficulty of stirring the carrier liquid and toner but, overall, they can be made useable if they can be obtained cheaply. If the pre-wet layer is formed satisfactorily and the thickness of the developing agent layer is between 5 and 40 $\mu$m, the developing agent can be used even at a viscosity of 10,000 mPa.s In this embodiment, the pre-wet liquid 220 impregnates the plate-shaped pre-wet liquid supply element 202, which is formed from a material with a three-dimensional mesh structure, such as BELEETA® registered trademark, in which the pores are three-dimensionally continuous. The pre-wet liquid supply element is brought into contact with the image bearing member, which is the photosensitive member 10, to supply the pre-wet liquid to the surface of the photosensitive member 10. In this way, a uniform thickness of pre-wet liquid can be applied without causing damage to the surface of the photosensitive member and, as a result, the adhesion of toner to the non-image parts on the photosensitive member can be prevented.

Note that large amounts of pre-wet liquid can be retained by the pre-wet liquid supply element if the BELEETA® (Registered trademark) has a large pore capacity. This causes a time lag between commencement of the supply of pre-wet liquid to the pre-wet liquid supply element and commencement of pre-wet liquid application to the surface of the photosensitive member. However, this type of time lag does not occur in this embodiment because the pre-wet liquid 220 is circulated continuously inside the pre-wet liquid supply element 202.

A developing belt 510 formed from a flexible material is used as the image bearing member in the first embodiment of this invention. This allows the contact pressure to be distributed when the developing agent layer formed on the developing belt 510 and the pre-wet liquid layer formed on the photosensitive member 10 are brought into contact. As a result, the two-layer structure of the developing agent layer and the pre-wet liquid layer is maintained when the layers are brought into contact during the developing process and, at completion of the developing process, the two layers are separated at a point within the pre-wet liquid layer. This prevents disturbance of the pre-wet liquid layer and, as a result, prevents adhesion of toner to the non-image parts on the image bearing member and prevents image inaccuracies.

A transfer belt 602 formed from a flexible material is used as the transfer member in the first embodiment of this invention. This allows the contact pressure to be distributed when the toner image formed on the latent image surface on the photosensitive member 10 and the paper, which is the recording medium, are brought into contact. This prevents the occurrence of inaccuracies in the toner image and, as a result, the toner image can be transferred to the paper without the image spreading.

The transfer belt 602 in the first embodiment has an electric resistance value of $10^4$ to $10^{11}$ Ωcm. As a result, the toner image that has been formed on the photosensitive member 10 can be transferred well to the paper.

In addition, a fluorine coating is applied to the surface of the transfer belt 602 in this embodiment. This improves the toner release properties and, as a result, the toner adhering to the transfer belt 602 can be released easily and the transfer belt is prevented from becoming dirty.

Silicone oil is used as the carrier liquid in the liquid developing agent in the first embodiment. In comparison with the carrier liquids in related art, silicone oil has the advantages described below.

In the liquid developing agents in related art, an isoparaffinic solvent such as ISOPAR® (Registered trademark of the Exxon Corporation) is generally used as the carrier liquid. Since the resistance value for Isopar is not as high as for silicon oil, the toner charge properties deteriorate as the toner concentration is increased, that is, as the space between particles becomes smaller.

Accordingly, the toner concentration levels are limited for ISOPAR®. In contrast, the silicone oil used in the first embodiment has a sufficiently high resistance value to allow increases in the toner concentration. Generally, the toner disperses well in ISOPAR® and, therefore, the toner particles tend to repel each other even when the toner concentration is 1 to 2%, allowing uniform toner dispersion. In contrast, toner does not disperse well in silicone oil at concentrations of 1 to 2% and precipitates easily. However, if the toner concentration is increased to a level from 5 to 40%, the toner becomes tightly packed and disperses evenly. Thus, a highly viscous liquid developing agent in which the toner is very densely dispersed can be used in the first embodiment. As a result, the volume of developing liquid can be greatly reduced in comparison with the low-concentration liquid developing agents in related art, and reduction in the size of the apparatus can be achieved. Furthermore, since the liquid developing agent used in the first embodiment is a highly viscous liquid, handling and storage is easier than with the low-viscosity liquid developing agents and powder developing agents of related art.

The ISOPAR used in the liquid developing agents in related art is highly volatile and releases an unpleasant odour, as mentioned above. This adversely affects the work environment and causes environmental problems. In contrast, the silicon oil used in the first embodiment is a safe liquid, as amply evidenced by its use in cosmetic products, and is odourless. Thus, use of the first embodiment can improve the work environment and avoid environmental problems.

Note that this invention is not restricted to the above embodiment and that various modifications are possible within the scope of the essential requirements. For example, in the pre-wet apparatus in the above embodiment, the pre-wet liquid 220 circulates continuously in the pre-wet liquid supply element 202, as already explained, but this invention is not restricted in this matter. The pre-wet apparatus may supply the pre-wet liquid to the pre-wet liquid supply element at the time of pre-wetting only.

Figure 20A:
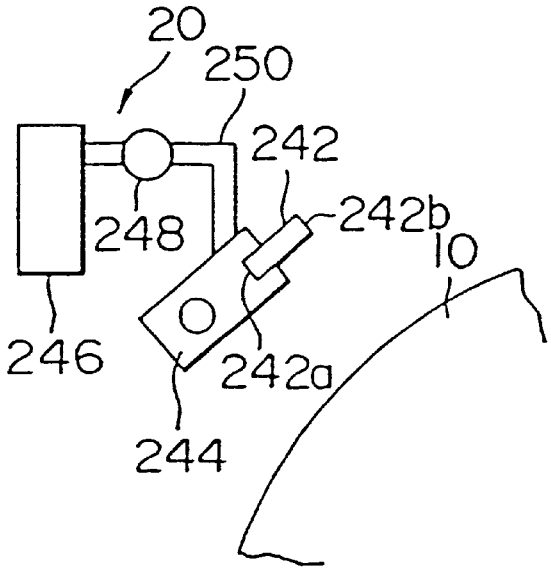
FIGS. 20A and 20B show examples of modifications to the pre-wet apparatus that can be used by the liquid developing apparatus of this invention.
Figure 20B:
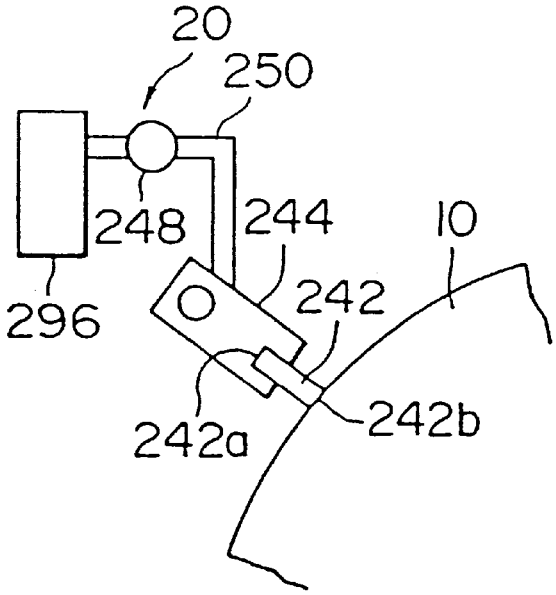

FIG. 20A and 20B show examples of modified pre-wet apparatus that can be used by the above embodiment of the electrostatic latent image liquid developing apparatus. The pre-wet apparatus 20 examples shown in FIGS. 20A and 20B are provided with a plate-shaped pre-wet liquid supply element 242 that is roughly as long as the width of the image created on the photosensitive member 10, a casing 244 that houses the supply edge 242*a* of the pre-wet liquid supply element 242, a tank 246 that stores the pre-wet liquid 220, a pump 248 that, on the basis of an externally input signal, draws up the pre-wet liquid 220 that is stored in the tank 246, tube 250, and position changing apparatus not illustrated. The tube 250 carries the pre-wet liquid 220 that is drawn up by the pump 248 to the supply edge 242*a* of the pre-wet liquid supply element 242. Note that an empty space is formed between the casing 244 and the supply edge 242*a* of the pre-wet liquid supply element 242. The pre-wet liquid 220 accumulates in this empty space before being supplied from the supply edge 242*a*. The position changing apparatus holds the pre-wet liquid supply element 242 in the separated position from the photosensitive member 10, as shown in FIG. 20A, when an external signal is not input. When an external signal is input, the pre-wet liquid supply element 242 abuts the photosensitive member 10, as shown in FIG. 20B. When an external signal is input, the pre-wet apparatus 20 supplies the pre-wet liquid 220 to the pre-wet liquid supply element 242 by means of the pump 248 and, at the same time, moves the release edge 242*b* of the pre-wet liquid supply element 242 into contact with the photosensitive member 10 by means of the position changing apparatus. Pre-wet liquid 220 in excess of the capacity of the pores in the BELEETA® registered trademark, which is a continuously porous material that has a three-dimensional mesh structure, used as the pre-wet liquid supply element 242 is released from the release edge 242*b* of the pre-wet liquid supply element 242 and applied to the photosensitive member 10. In this way, a uniform thickness of pre-wet liquid can be applied without causing damage to the surface of the photosensitive member.

Note that large amounts of pre-wet liquid can be retained by the pre-wet liquid supply element if the BELEETA® (Registered trademark) has a large pore capacity. This causes a time lag between commencement of the supply of pre-wet liquid to the pre-wet liquid supply element and commencement of pre-wet liquid application to the surface of the photosensitive member. Accordingly, it is desirable that the length of the pre-wet liquid supply element 242 in the direction of flow of the pre-wet liquid 220 be as short as possible.

The continuously porous sponge material, BELEETA® (Registered trademark) used as the pre-wet liquid supply element in the above embodiment has already been explained. However, this invention is not restricted in this matter. As long as a fixed quantity of pre-wet liquid can be applied to the surface of the photosensitive member, an element other than continuously porous sponge, for example, a rubber roller, may be used. Similarly, this invention is not restricted to use of a plate shape.

Figure 21:
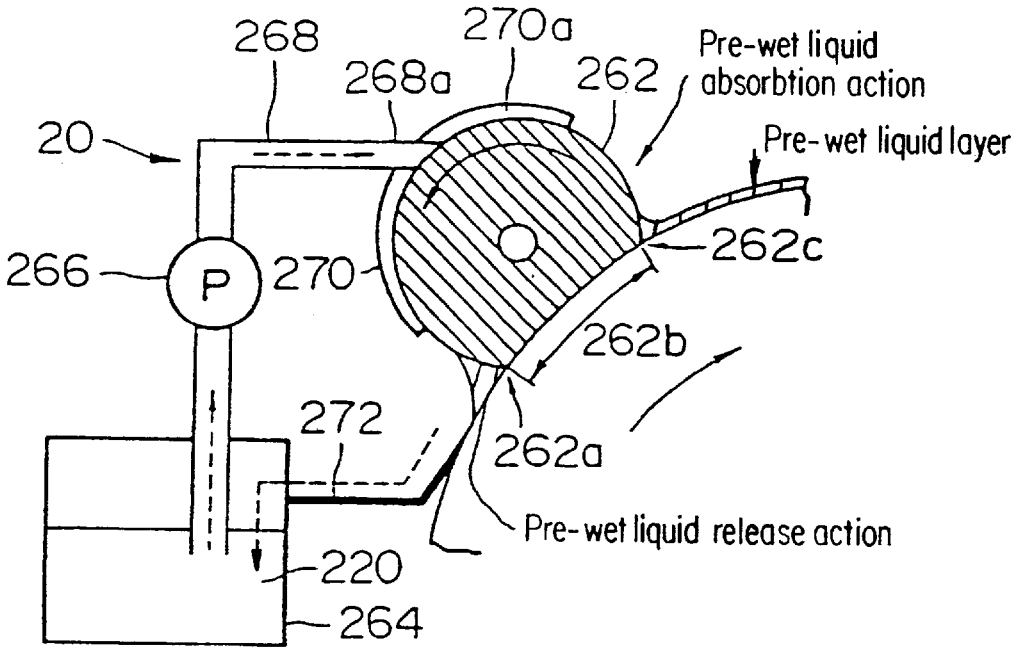
FIG. 21 shows another example of modified pre-wet apparatus that can be used by the liquid developing apparatus shown in FIG. 1.
Figure 22:
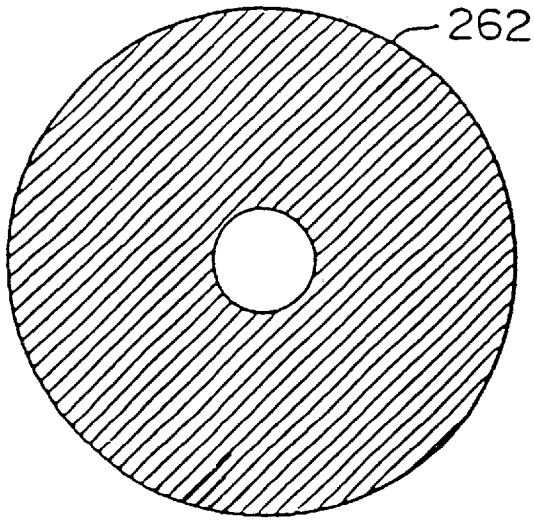
FIG. 22 is a cross-section of a pre-wet liquid supply element that can be used by the pre-wet apparatus shown in FIG. 21.

The pre-wet apparatus of this embodiment, shown in FIG. 21, may be provided with a pre-wet liquid supply element 262 that is formed in a cylindrical shape, as shown in FIG. 22, and that is roughly as long as the width of the image created on the surface of the photosensitive member 10, a tank 264 that stores the pre-wet liquid 220, a pump 266 that draws up the pre-wet liquid 220 that is stored in the tank 264, a tube 268 that carries the pre-wet liquid 220 that is drawn up by the pump 266 to the pre-wet liquid supply element 262, a guide 270, and a trap 272.

The pre-wet liquid supply element 262 is rotated in the opposite direction to the direction of rotation of the photosensitive member 10 by a drive roller not illustrated in the drawing. Experiments performed by the inventors et al. showed that good results can be obtained during formation of the thin layer of pre-wet liquid 220 on the photosensitive member 10 if the pre-wet liquid supply element 262 rotates at roughly the same speed as the photosensitive member 10. In addition, position changing apparatus not illustrated prevents free changes to the position of the pre-wet liquid supply element 262 by, normally, maintaining the separated position from the photosensitive member 10. The pre-wet liquid supply element is brought into contact with the photosensitive member 10, as shown in FIG. 21, only during pre-wetting. A continuously porous sponge that has a three-dimensional mesh structure in which the pores are continuous is used as the pre-wet liquid supply element 262. The amount of pre-wet liquid that can be retained by the continuously porous sponge is limited to the capacity of the pores, and the retained pre-wet liquid is released by applying pressure to change the capacity of the pores. In this embodiment, the average pore diameter is 100 to 800 $\mu$m, the hardness is 20 to 50 degrees, and the sponge is pushed against the photosensitive member at a pressure of 200 to 1,000 g/cm$^2$. The guide 270 is disposed such that it covers part of the pre-wet liquid supply element 262 in the vicinity of the pre-wet liquid release edge 268*a* of tube 268. The pre-wet liquid 220 accumulates in the space 270*a* formed between the guide 270 and the pre-wet liquid supply element 262, then is absorbed by the pre-wet liquid supply element 262. A liquid receptor 272 is disposed at the lower side of the pre-wet liquid supply element 262 and returns excess pre-wet liquid 220 released from the pre-wet liquid supply element 262 to the tank 264.

When pre-wetting starts, the pre-wet apparatus 20 rotates the pre-wet liquid supply element 262 in the opposite direction to the direction of rotation of the photosensitive body 10 and, at the same time, brings the pre-wet liquid supply element into contact with the photosensitive member 10. At that time, the pre-wet liquid 220 that is held by the pre-wet liquid supply element 262 is released from the leading edge 262*a* of the contact between the photosensitive member 10 and the pre-wet liquid supply element 262, due to the elastic deformation produced in the pre-wet liquid supply element 262, and is applied to the photosensitive member 10 at a uniform thickness from the nip width 262*b* formed between the photosensitive member 10 and the pre-wet liquid supply element 262. Excess pre-wet liquid 262 that has been supplied to the photosensitive member 10 is returned to the tank 264 via the liquid receptor 272 and is absorbed again in the pre-wet liquid supply element 262 at the trailing edge 262*c* of the contact between the photosensitive member 10 and the pre-wet liquid supply element 262.

Figure 23:
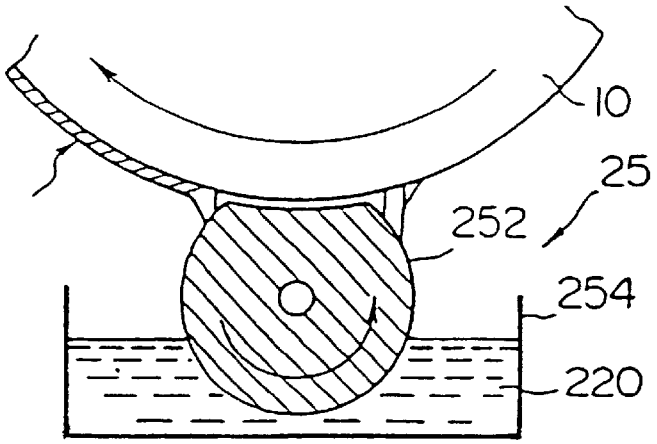
FIG. 23 shows another example of modified pre-wet apparatus that can be used by the liquid developing apparatus shown in FIG. 1.

Alternatively, as in the pre-wet apparatus 25 shown in FIG. 23, the pre-wet liquid 220 may be supplied to the pre-wet liquid supply element 252 by means of the pre-wet liquid supply element 252 being disposed such that the lower part is soaked in the pre-wet liquid 220 that is stored in the tank 254.

Figure 24A:
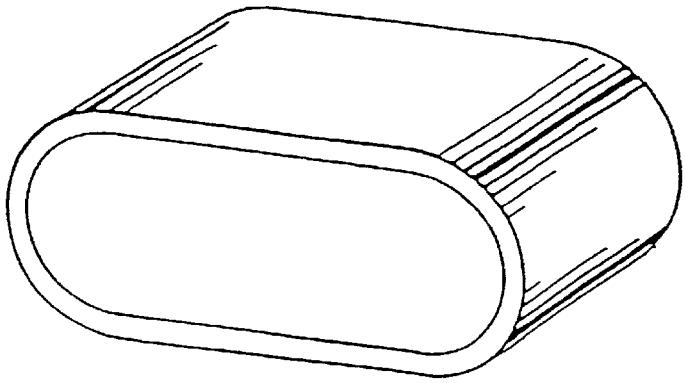
FIGS. 24A and 24B show examples of modified pre-wet liquid supply elements that can be used by the liquid developing apparatus of this invention.
Figure 24B:
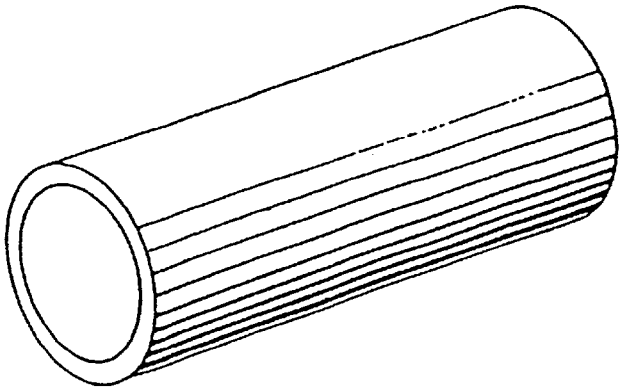

The continuously porous sponge material used as the pre-wet liquid supply element in the above embodiment has already been explained, but this invention is not restricted in this matter. The pre-wet liquid supply element may be formed from any liquid-permeable and liquid-retentive elastic material. In addition, the shape is not restricted to a plate shape or cylindrical shape and may be formed, for example, as an endless belt as shown in FIGS. 24A and 24B.

The use of three drive rollers 512*a*, 512*b*, and 512*c* in the first embodiment to support the developing belt 510 and provide rotational drive has already been explained, but this invention is not restricted in this matter. One drive roller and a driven roller, for example, may be used for support and for providing the rotational drive.

Figure 25:
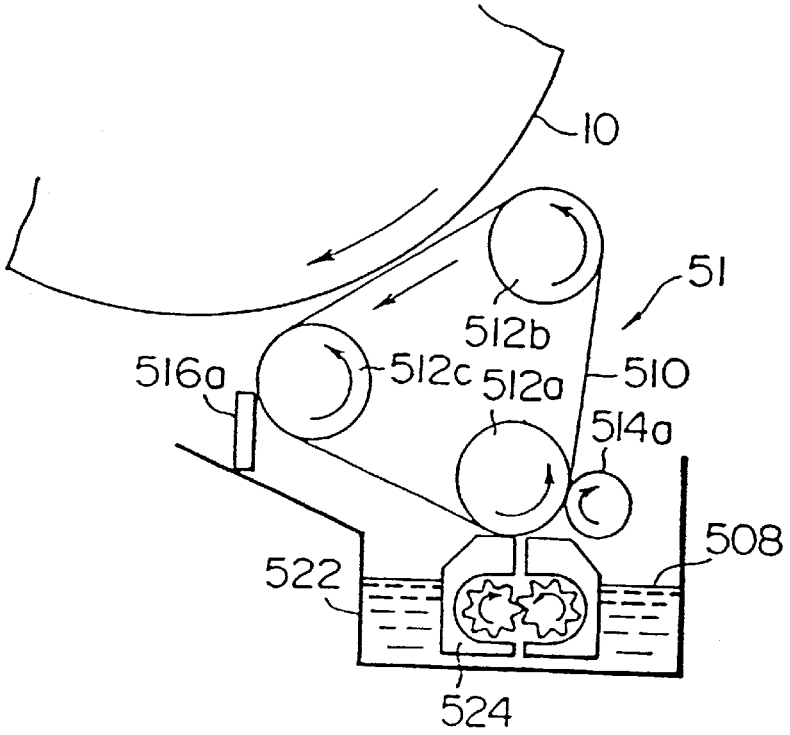
FIG. 25 shows an example of modified developing agent supply apparatus that can be used by the liquid developing apparatus of this invention.

In addition, the use of a bellows pump 502 and a developing agent supply roller 506 in the first embodiment as the mechanism for supplying the liquid developing agent 508 to the developing belt 510 has already been explained, but this invention is not restricted in this matter. A double gear pump 524, for example, may be disposed such that it is immersed in the liquid developing agent 508 that is stored in the tank 522, as in the developing apparatus 51 shown in FIG. 25, and be used to draw up the liquid developing agent 508 that is stored in the tank 522 in order to supply the liquid developing agent to the developing belt 510.

Figure 26:
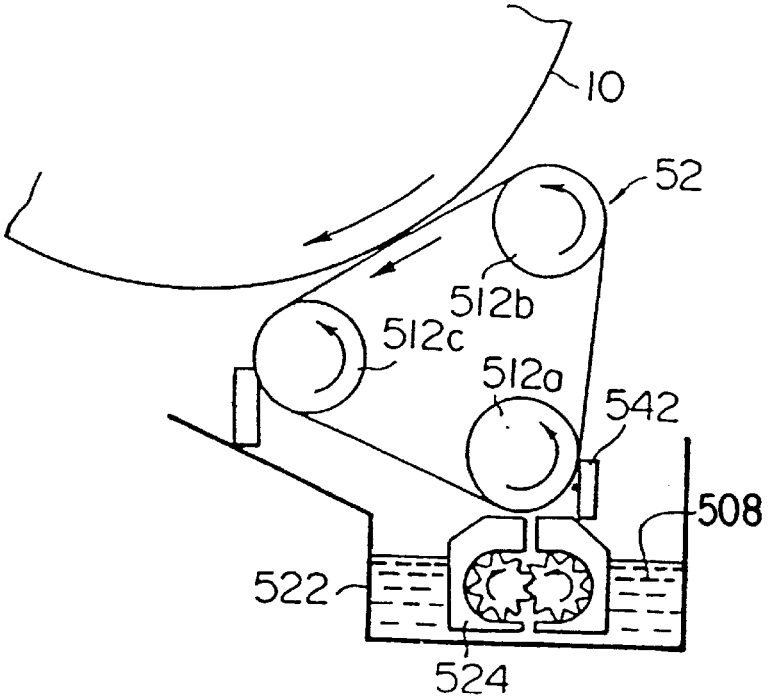
FIG. 26 shows use of a regulatory blade instead of the regulatory roller that is used in the developing agent supply apparatus shown in FIG. 25.

Furthermore, the use of a regulatory roller 514*a* in the first embodiment to regulate the thickness of and form a thin film of the liquid developing agent 508 that has been applied to the developing belt 510 has already been explained, but this invention is not restricted in this matter. A regulatory blade 542 formed from rubber or a rigid material, for example, may be used, as in the developing apparatus 52 shown in FIG. 26, to regulate the thickness of and form a thin film of the liquid developing agent 508 that has been applied to the developing belt 510. Experiments performed by the inventors et al. showed that a uniform thin film of developing agent can be formed by a design wherein the method of contact between the regulatory blade 542 and the developing belt 510 is such that the side surface of the regulatory blade touches the developing belt in the trailing direction and the front end of the regulatory blade 542 protrudes beyond the contact face of the regulatory blade and the developing belt.

Figure 27:
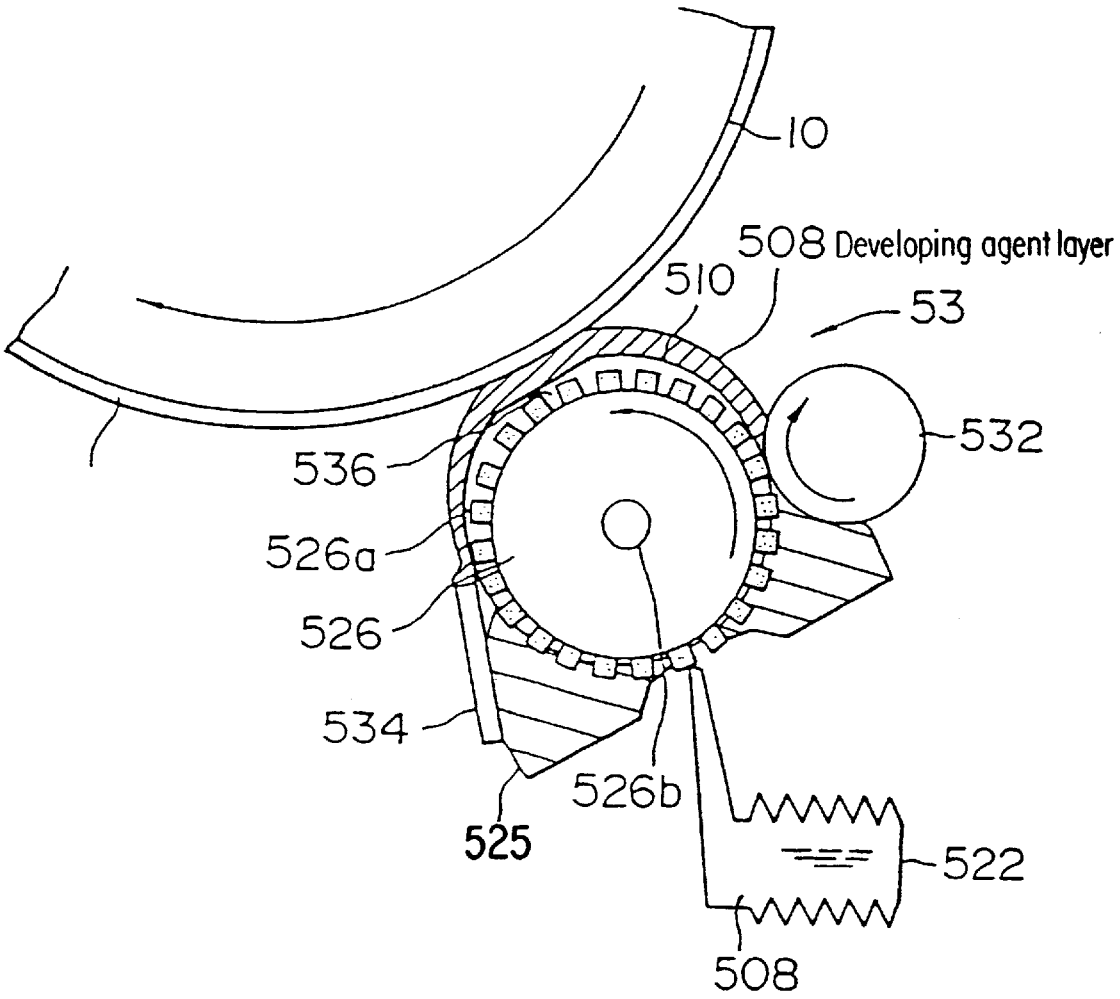
FIG. 27 shows another example of modified developing agent supply apparatus that can be used by the liquid developing apparatus in this invention.

The developing apparatus in this embodiment may be the developing apparatus 53 shown in FIG. 27, that is, may be apparatus provided with a developing belt 510, formed as a seamless cylinder from an element in sheet form, as the developing agent supply member, a drive roller 526 that is disposed inside the developing belt 510 and that provides the rotational drive for the developing belt 510, a guide element 525 that is positioned on the opposite side to the position where the photosensitive member 10 is disposed and touches both ends of the drive roller 526 through the medium of the developing belt such that a space 536 is formed between the developing belt 510 and the drive roller 526 on the side where the developing belt 510 and the photosensitive member 10 touch, a bellows pump 522 that stores the liquid developing agent 508 and also supplies the liquid developing agent 508 to the developing belt 510 on the side where the developing belt 510 and the drive roller 526 touch, a regulatory roller 532 that regulates the thickness of the layer of liquid developing agent 508 that is supplied to the developing belt 510, and a scraper blade 534 that scrapes off the liquid developing agent 508 that adheres to the developing belt 510.

Figure 28A:
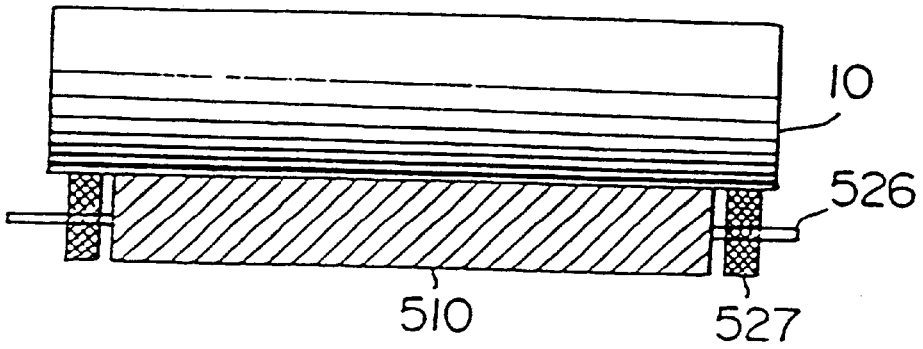
FIGS. 28A and 28B show the method used for making contact between the developing belt shown in FIG. 27 and the photosensitive member.
Figure 28B:
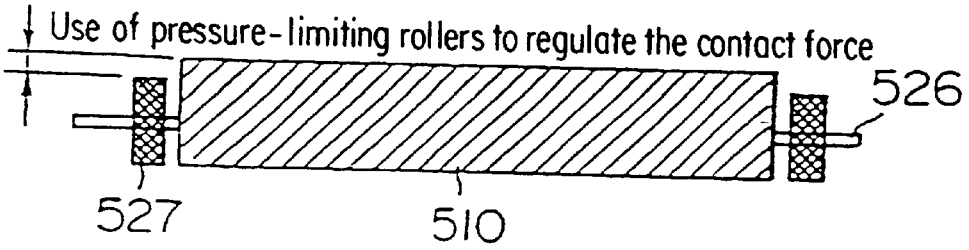

The developing belt 510 is roughly the same length as the photosensitive member 10 and is formed from a conductive and flexible sheet element. The materials that may be used for the developing belt 510 include polycarbonate, polyamide resin, fluoropolymers, polyimide, and urethane rubber, with the addition of fine metal powder or other conductive particles. Alternatively, a material that has had a conductive process applied to its surface, a material such as nickel, aluminium, or stainless steel at thicknesses of 50 $\mu$m or less, or a conductive material with an electric resistance value of $10^6$ Ωcm or less may be used. As shown in FIG. 27, the developing belt 510 abuts the photosensitive member 10 such that a bend is produced at the developing space. The developing belt rotates in the opposite direction to the direction of rotation of the photosensitive member 10 and thereby carries the liquid developing agent 508, that has been supplied from the bellows pump 522, to the surface of the photosensitive member 10. The contact force when the developing belt 510 comes into contact with the photosensitive member 10, as shown in FIGS. 28A and 28B, is regulated by exchanging the pressure-limiting rollers 527, that are disposed on both ends of the central axle 526*b* (FIG. 27) of the drive roller 526, with pressure-limiting rollers of different diameters.

The drive roller 526 is formed such that the external diameter is smaller than the inside diameter of the developing belt 510 and such that, when the developing belt 510 is made eccentric by the side of the photosensitive member 10, a space 536 is formed. A conductive rubber roller that has a low electric resistance value that allows application of a developing bias is used as the drive roller. Note that sprockets 526*a* are provided at both ends of the drive roller. The sprockets engage with the perforations 510*a* provided on both ends of the developing belt, as shown in FIG. 7, to provide an even rotational drive to the developing belt 510.

The guide element 525 is coated with a compound that provides good non-stick properties, such as a tetrafluoroethylene TEFLON® registered trademark, on the surface that touches the developing belt 510 in order to make the coefficient of dynamic friction between the developing belt 510 and the guide element 525 smaller than the coefficient of dynamic friction between the developing belt 510 and the drive roller 526.

Regulatory roller 532 is disposed such that it abuts the developing belt 510 and rotates in the opposite direction to the direction of rotation of the developing belt 510. Experiments performed by the inventors et al. showed that good results can be obtained for the formation of a thin layer of liquid developing agent 508 on the developing belt 510 if the regulatory roller 532 rotates about twice as fast as the developing belt 510 rotation speed. Note that a flexible material, such as rubber or sponge, is used for the regulatory roller 532.

Thus, a developing belt 510 formed from a conductive thin-membrane material is used as the developing agent bearing member, and the guide element 524 brings the developing belt 510 into contact with the photosensitive member 10 such that a space 536 is formed between the developing belt 510 and the drive roller 526 on, at least, the side of the developing belt 510 that faces the photosensitive member 10. This produces a bend in the developing belt 510 and allows formation of minute gap d between the surface where the electrostatic latent image is formed on the photosensitive member 10 and the developing belt 510.

In developing apparatus 53, a developing belt 510 formed from a conductive flexible sheet material formed in a cylindrical shape is used as the developing agent bearing member, and the guide element 524 brings the developing belt 510 into contact with the photosensitive member 10 such that a space 536 is formed between the developing belt 510 and the drive roller 526 on, at least, the side of the developing belt 510 that faces the photosensitive member 10. This produces a bend in the developing belt 510, and this bend allows the contact pressure to be distributed when the developing agent layer formed on the developing belt 510 and the pre-wet liquid layer formed on the photosensitive member 10 touch. Consequently, the two-layer structure of the developing agent layer and the pre-wet liquid layer can be maintained while the two layers are in contact during the development process. Moreover, the two layers can be separated at a point within the pre-wet liquid layer at the end of the developing process and disturbance of the pre-wet liquid layer can be prevented. As a result, the adherence of toner to the non-image parts on the image bearing member can be prevented and clean images can be produced.

The drive roller 526 that provides the rotational drive for the developing belt 510 is disposed inside the developing belt 510. This is a simpler construction than that seen in electrostatic latent image liquid developing apparatus in related art and makes it easier to reduce the size of the apparatus.

In this embodiment, perforations 510*a* (FIG. 7) are provided in both ends of the developing belt 510, and sprockets 526*a* that engage the perforations 510*a* are provided at both ends of the drive roller 526. As a result, the developing belt 510 can be rotated evenly.

In this embodiment, the contact force of the developing belt 510 against the photosensitive member 10 is regulated by means of the pressure-limiting rollers 527. Thus, when the developing agent layer formed on the developing agent bearing member and the pre-wet liquid layer formed on the image bearing member touch, the contact force can be easily controlled to provide the optimum force.

In this embodiment, a low impedance circuit is formed between the developing belt 510 and the photosensitive member 10, which facilitates the migration of the toner from the developing belt 510 to the photosensitive member 10.

The perforations 510*a* provided in both ends of the developing belt 510 and the sprockets 526*a* that engage the perforations 510*a* and that are provided at both ends of the drive roller 526 in the above developing agent supply apparatus have already been described but, instead of these perforations and sockets, a drive roller provided with grooves in a chequered pattern or protuberances on the surface may be used. This provision also enables the developing belt 510 to be rotated evenly.

Figure 29:
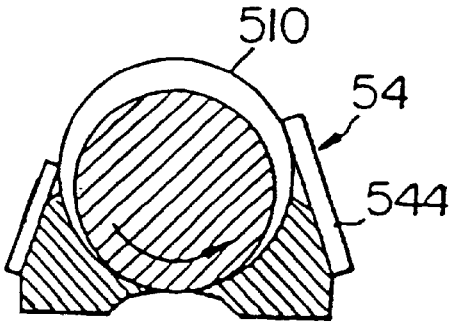
FIG. 29 shows an example of a modification to the developing agent supply apparatus shown in FIG. 25.

Furthermore, as in the developing apparatus 54 shown in FIG. 29, a regulatory blade 544 formed from a material such as chlorosilicon rubber or fluororubber may be used to regulate the thickness of the layer and to form a thin film of the liquid developing agent applied to the developing belt 510. Experiments performed by the inventors et al. showed that a uniform thin film of developing agent can be formed by a design wherein the method of contact between the regulatory blade 544 and the developing belt 510 is such that the side surface of the regulatory blade touches the developing belt in the trailing direction and the front end of the regulatory blade 544 protrudes beyond the contact face of the regulatory blade and the developing belt. Note that a rubber hardness of 70 degrees was used for the regulatory blade 544.

Figure 30:
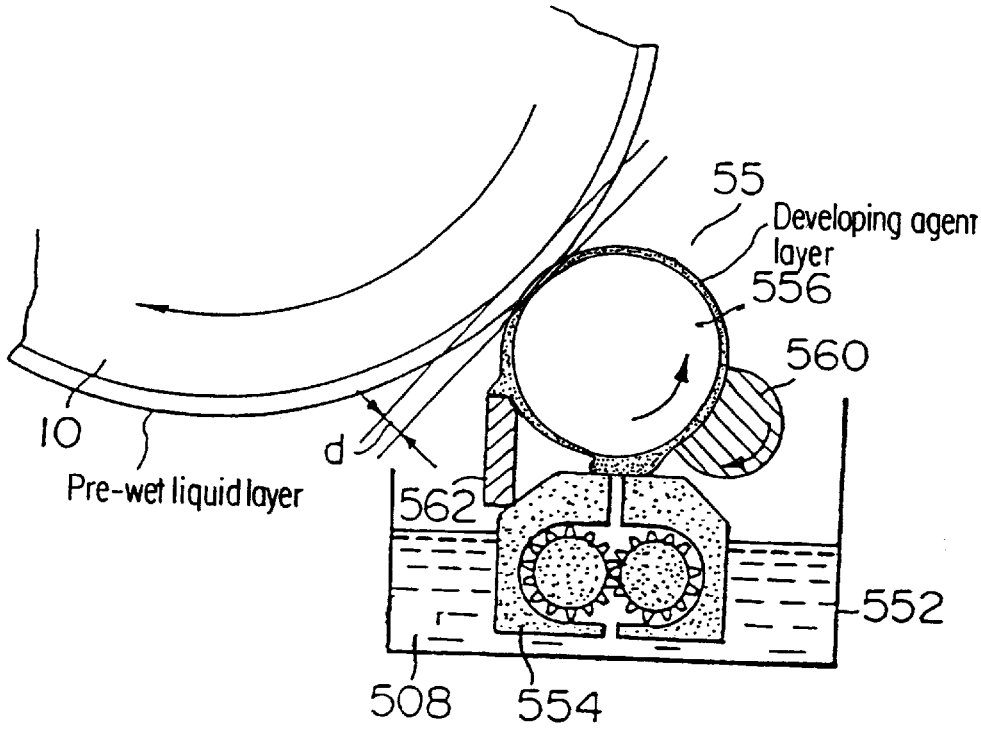
FIG. 30 shows another example of modified developing agent supply apparatus that can be used by the liquid developing apparatus in this invention.

The developing apparatus of this embodiment may be the apparatus shown in FIG. 30 wherein a developing roller is used instead of a developing belt. In FIG. 30 shows provision of a tank 552 that stores the liquid developing agent 508, a double gear pump 554 that is disposed such that it is immersed in the liquid developing agent 508 in the tank 552, a developing roller 556 which is the developing agent bearing member and that is disposed above the double gear pump, a regulatory roller 560 that is formed from an elastic element and that regulates the thickness of the layer of liquid developing agent 508, and a scraper blade 562.

Figure 31:
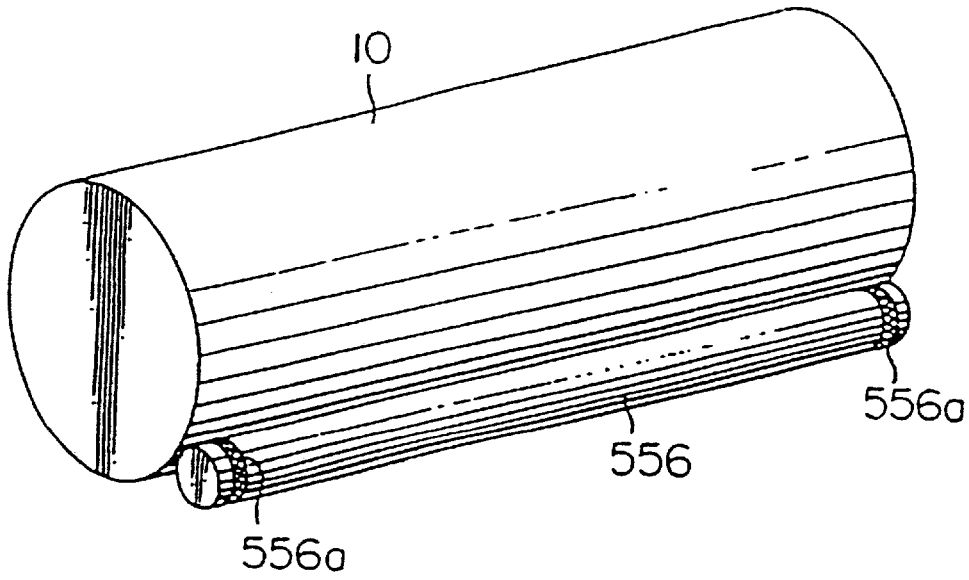
FIG. 31 shows the locations of the clearance gap maintenance elements that can be used with the developing agent supply mechanism shown in FIG. 30.

The double gear pump 554 draws up the liquid developing agent 508 that is stored in the tank 552 and supplies the liquid developing agent to the developing roller 556. The developing roller 556 is roughly as long as the width of the image created on the photosensitive member 10 and rotates in the opposite direction to the direction of rotation of the photosensitive member 10, thereby carrying the liquid developing agent 508, supplied by the double gear pump 554, to the surface of the photosensitive member 10. A clearance gap maintenance element 556*a* formed as a long narrow strip of MYLAR® or polyimide is wound around both ends of the developing roller 556, as shown in FIG. 31, and the developing roller 556 is disposed such that the clearance gap maintenance element abuts both ends of the photosensitive member 10. As a result, developing gap d is formed between the developing roller 556 and the photosensitive member 10. Note that a metal is used for the developing roller 556 so that a developing bias can be applied.

The regulatory roller 560 is disposed such that it pushes against the developing roller 556 and rotates in the opposite direction to the direction of rotation of the developing roller 556. Experiments performed by the inventors et al. showed that good results can be obtained for the formation of a thin layer of liquid developing agent 508 on the developing roller 556 if the regulatory roller 560 rotates about twice as fast as the developing roller 556 rotation speed. The scraper blade 562 scrapes off the liquid developing agent 508 that has adhered to the developing roller 556.

The liquid developing agent 508 that is stored in the tank 552 is drawn up by the double gear pump 554 and supplied to the developing roller 556, as shown in FIG. 30. Then, the regulatory roller 560 adjusts the thickness of the film to form a thin film on the developing roller 556. The layer of liquid developing agent that has been formed in this way on the developing roller 556 is brought adjacent to the photosensitive member 10 and touches the pre-wet liquid layer that has been formed on the photosensitive member 10. This allows the electromagnetic force to move the charged toner to the electrostatic latent image that has been formed on the surface of the photosensitive member 10. The liquid developing agent 508 remaining on the developing roller 556 is scraped off by the scraper blade 562 and returned to the tank 552.

The clearance gap maintenance element 556*a* wound around both ends of the developing roller 556 in this embodiment results in the formation of the developing gap d between the photosensitive member 10 and the developing roller 556 and simplifies the maintenance of a fixed distance between the photosensitive member 10 and the developing roller 556.

A bellows pump may be used as the mechanism for supplying the liquid developing agent 508 to the developing roller 556. In addition, use of a metal for the developing roller 556 has already been explained but, as long as the surface, at least, is conductive, any material can be used for the developing roller 556.

Figure 32:
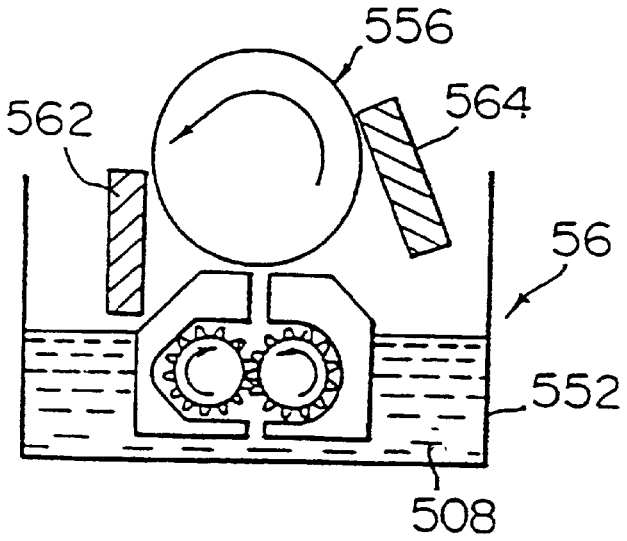
FIG. 32 shows another example of modified developing agent supply apparatus that can be used by the liquid developing apparatus in this invention.

As in the developing apparatus 56 shown in FIG. 32, a regulatory blade 564 formed from rubber or a rigid substance may be used to regulate the thickness of and form a thin film of the liquid developing agent 508 applied to the developing roller 556. Experiments performed by the inventors et al. showed that a uniform thin film of developing agent can be formed by a design wherein the method of contact between the regulatory blade 564 and the developing roller 556 is such that the side surface of the regulatory blade touches the developing roller in the trailing direction and the front end of the regulatory blade 564 protrudes beyond the contact face of the regulatory blade 564 and the developing roller 556.

Figure 33:
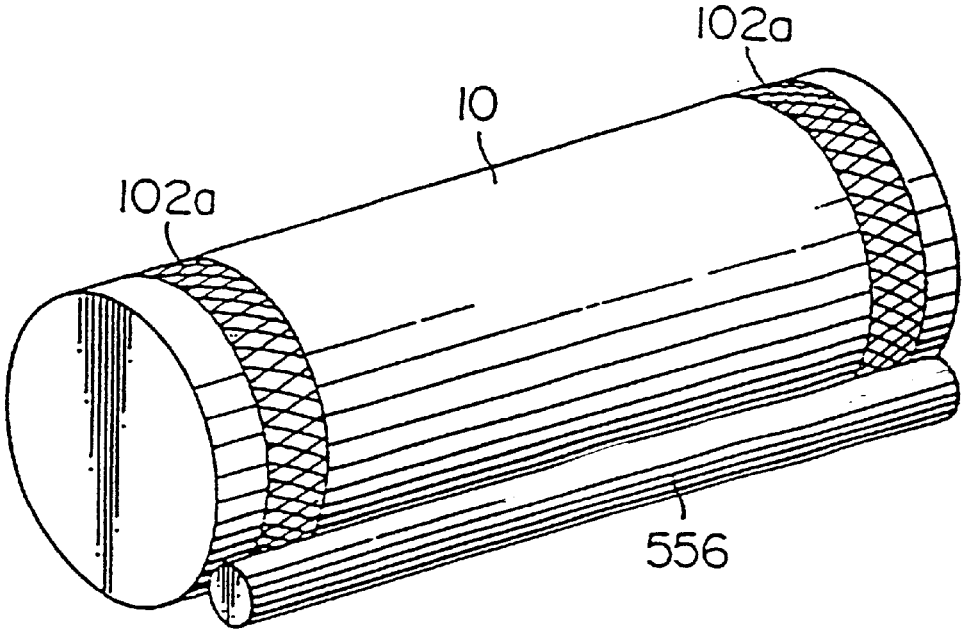
FIG. 33 shows another example of the locations of the clearance gap maintenance elements.

As shown in FIG. 33, the developing gap d between the photosensitive member 10 and the developing roller 556 may be formed by winding the clearance gap maintenance element 102*a* around both ends of the photosensitive member 10 and disposing the developing roller 556 such that both ends abut the clearance gap maintenance element. Use of a clearance gap maintenance element formed from a long narrow strip of MYLAR® or polyimide has already been explained, but the clearance gap maintenance element may also be formed by applying a coating of TEFLON®, shaped as a long narrow strip, on both ends of either the photosensitive member 10 or the developing roller 556.

Figure 34:
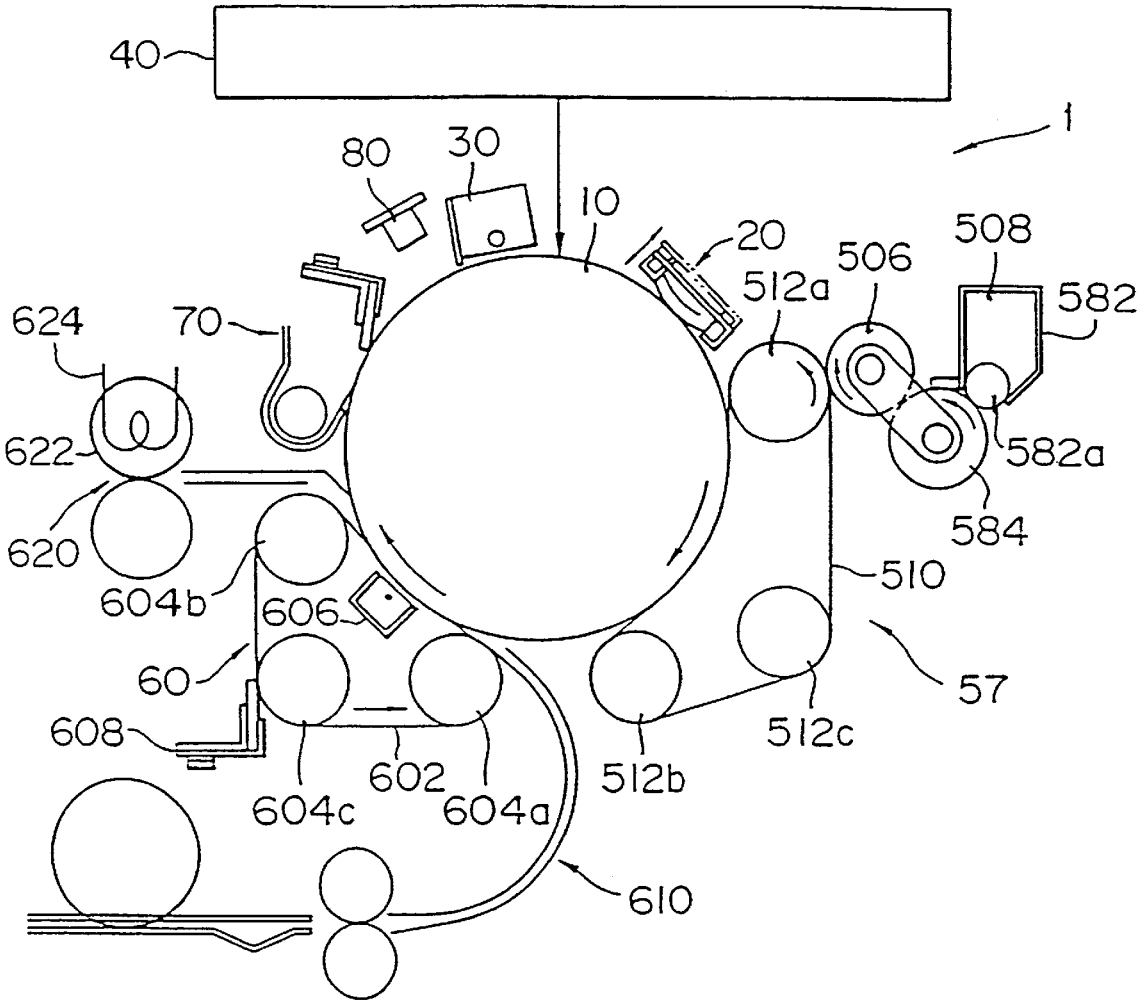
FIG. 34 is an overview of the structure of a modified example of the electrostatic latent image liquid developing apparatus in the first embodiment of this invention.

FIG. 34 explains the format of a different developing agent supply apparatus that can be used in this embodiment. FIG. 34 shows a format in which the elements of the liquid developing apparatus are in a different sequence and in which the photosensitive member is a drum. The developing apparatus 57 in FIG. 34 is provided with a developing agent bearing member in the form of a developing belt 510, drive rollers 512*a*, 512*b*, and 512*c* which provide the rotational drive for the developing belt 510 and, at the same time, support the developing belt 510 such that part of the developing belt comes into contact with the photosensitive member 10, an application roller 506 that applies the liquid developing agent 508 to the developing belt 510, a tank 582 which stores the liquid developing agent 508, a release roller 582*a* that is disposed at the release aperture of the tank 582 and that releases the liquid developing agent 508 stored in the tank 582, a supply roller 584 that supplies the liquid developing agent 508 released by the release roller 582*a* to the application roller 506, a regulatory mechanism not illustrated in the drawing such as a blade or roller that regulates the thickness of the layer of liquid developing agent 508 that has been applied to the developing belt 510, and a scraper blade not illustrated that scrapes off the liquid developing agent 508 adhering to the developing belt 510 after the developing process.

The supply roller 584 rotates in the opposite direction to the direction of rotation of the application roller 506 and, thereby, carries the liquid developing agent 508 that is released by the release roller 582*a* to the surface of the application roller 506. The application roller 506 rotates in the opposite direction to the direction of rotation of the developing belt 510 and, thereby, applies the liquid developing agent 508 that is supplied by the supply roller 584 to the surface of the developing belt 510. The use of rollers, the supply roller 584 and the application roller 506, is an effective means of supplying the liquid developing agent 508 to the developing belt 510 because a liquid developing agent 508 in which the toner is dispersed at a high concentration is used and, therefore, large quantities of developing agent are not required. Therefore, rollers can provide an even application of the developing agent to the surface of the developing belt 510. Note that one or more carrier rollers may also be provided between the supply roller 584 and the application roller 506 to carry the liquid developing agent 508.

The developing belt 510 is rotated by the drive rollers 512*a*, 512*b*, and 512*c* in the opposite direction to the direction of rotation of the photosensitive member 10 and thereby carries to the surface of the photosensitive member 10 the liquid developing agent 508 that was applied to the developing belt by the application roller 506. A flexible material is used for the developing belt 510, which may be, for example, a seamless nickel belt or a polyimide or other resin belt. The flexibility of the developing belt allows the contact pressure to be distributed when the developing agent layer formed on the developing belt 510 and the pre-wet liquid layer formed on the photosensitive member 10 are brought into contact. As a result, the two-layer structure of the developing agent layer formed on the developing belt 510 and the pre-wet liquid layer formed on the photosensitive member 10 is maintained when the layers are brought into contact, and the two layers can be separated at a point within the pre-wet liquid layer. Note that the nature of the developing belt 510 must allow application of a developing bias. Accordingly, if a resin belt is used, minute conductive particles must be added to lower the electric resistance value or a conductive process must be applied to the surface of the belt. If the belt itself is conductive, rubber rollers with low electric resistance can be used as the drive rollers 512*a*, 512*b*, and 512*c* to allow application of the developing bias. Alternatively, if a conductive process has been applied to the surface of the belt, a conductor is disposed such that it touches the surface of the belt and the developing bias is applied to the conductor.

There is no essential difference between pre-wetting before the charge from the corona is applied and, as shown in FIG. 34, pre-wetting after the charging from the corona, image exposure, and formation of the latent image.

Figure 35:
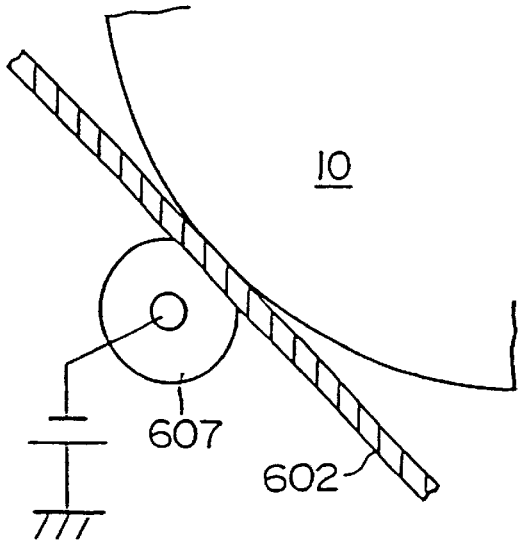
FIG. 35 shows an example of a modification to the transfer apparatus that can be used by the liquid developing apparatus in this invention.

Note that the transfer apparatus may use rubber rollers to which minute conductive particles have been added, to give a low electric resistance value, as the drive rollers that give the rotational drive to the transfer belt and the bias voltage may be applied to these drive rollers in order to apply the bias voltage to the transfer belt and transfer the toner image to the paper. Alternatively, as shown in FIG. 35, a conductive sponge roller 607 may be pressed against the back of the transfer belt 602 at the transfer point between the photosensitive member 10 and the transfer belt 602 to achieve a suitable pressure and, at the same time, a bias voltage may be applied to the sponge roller 607 in order to apply the bias voltage to the transfer belt 602 and transfer the toner image to the paper.

Alternatively, the transfer member may be formed from a material that has moderate elasticity such that the transfer member presses with moderate pressure.

Figure 36:
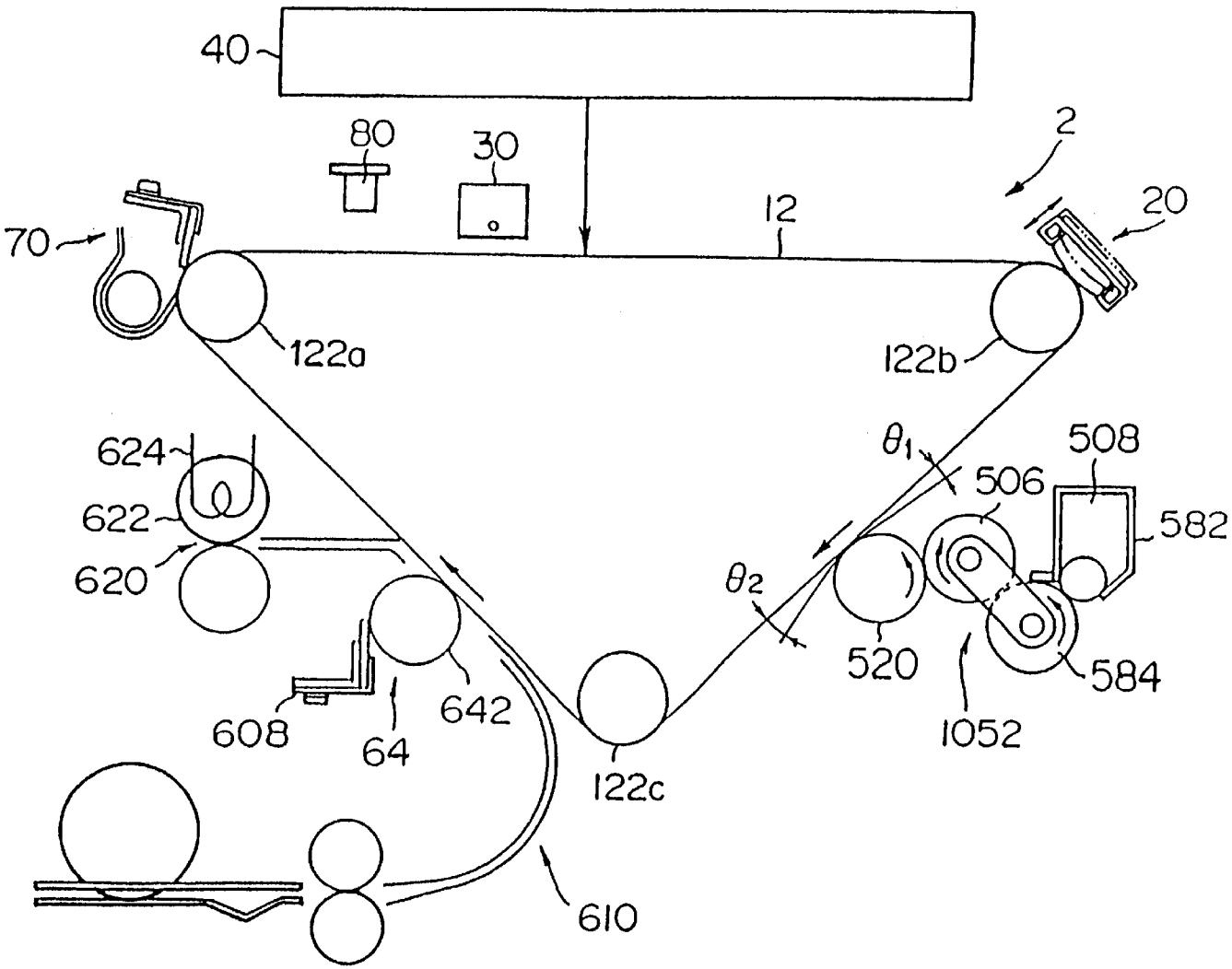
FIG. 36 is an overview of the structure of the liquid developing apparatus in the second embodiment of this invention.

FIG. 36 shows an overview of the structure of the liquid developing apparatus that is the second embodiment of this invention. Note that the elements of the electrostatic latent image liquid developing apparatus shown in FIG. 36 that have the same function as elements in the first embodiment are given the same or corresponding code numbers, and detailed explanations are not given for these elements.

The differences between the second embodiment of this invention, liquid developing apparatus 2, and the first embodiment are, as shown in FIG. 36, the use of a photosensitive belt 12 as the image bearing member instead of photosensitive member 10, the support and rotational drive provided by the drive rollers 122*a*, 122*b*, and 122*c* for the photosensitive belt, use of developing apparatus 1052 instead of developing apparatus 57, and use of transfer apparatus 64 instead of transfer apparatus 60.

A flexible element such as a seamless nickel belt, resin belt, or polyimide film belt is used as the base material for the photosensitive belt 12. This allows distribution of the contact pressure when the toner image formed on the developing belt 12 and the paper touch.

The difference between the developing apparatus 1052 of the second embodiment and the developing apparatus 57 of the first embodiment is that a developing roller 520 is used as the developing agent bearing member instead of a developing belt 510. The developing roller 520 rotates in the opposite direction to the direction of rotation of the photosensitive belt 12 and thereby carries to the surface of the photosensitive belt 12 the liquid developing agent 508 that was applied to the developing belt by the application roller 506. A conductive $10^4$ to $10^{11}$ Ωcm element such as a conductive rubber roller is used for the developing roller 520 so that a developing bias can be applied.

The differences between the transfer apparatus 64 of the second embodiment and the transfer apparatus 60 of the first embodiment are that a transfer roller 642 is used as the transfer member instead of a transfer belt 602, and that a power supply unit not illustrated that applies a bias voltage to the transfer roller 642 is provided instead of the corona discharge device 606 that applies to the transfer belt 602 a charge of opposite voltage to the toner.

The transfer roller 642 rotates in the opposite direction to the direction of rotation of the photosensitive belt 12. As a result, the paper carried by the paper feed apparatus 610 is fed between the photosensitive belt 12 and the transfer roller 642. A conductive element, such as a metal, is used for the transfer roller 642 so that a bias voltage can be applied. A value from $10^4$ to $10^{11}$ Ωcm is desirable as the electric resistance value of the transfer roller 642. Since the resistance value of the paper varies greatly ($10^9$ to $10^{13}$ Ωcm) in accordance with the paper type and the humidity, if the electric resistance value of the transfer roller is $10^4$ Ωcm or less, the change in the resistance value of the paper inappropriately affects the transfer to the paper of the toner image formed on the photosensitive belt 12. If the electric resistance value is $10^{11}$ Ωcm or higher the electrostatic force between the transfer roller 642 and the toner image formed on the photosensitive belt 12 becomes too weak, and insufficient toner is transferred to the paper.

A fluorine coating is applied to the surface of the transfer roller 642. This prevents the transfer roller 642 from becoming dirty because it improves the transfer roller's release properties in relation to the toner and makes it easier for the scraper blade 608 to scrape off the toner adhering to the transfer roller 642.

The transfer apparatus 64 with the above structure transfers the image formed on the photosensitive belt 12 to the paper that has been carried by the paper feed apparatus 610 and fed between the photosensitive belt 12 and the transfer roller 642. The electrostatic force generated between the toner image that has been formed on the photosensitive belt 12 and the transfer roller 642, to which the power supply unit has applied a developing bias, makes the toner migrate to the paper. Note that the other operations of the second embodiment of the electrostatic latent image liquid developing apparatus are the same as in the first embodiment and, therefore, details of these operations are not explained.

In the second embodiment of this invention, a photosensitive belt 12 formed from a flexible element is used as the image bearing member, resulting in soft contact between the photosensitive belt 12 and the developing roller 520 and formation of a suitable minute gap d. The use of a flexible element also allows distribution of the contact pressure when the toner image formed on the latent image on the photosensitive belt 12 and the paper that is the recording medium touch. Thus, as with the first embodiment, toner image inaccuracies are prevented and the toner image can be transferred to the paper without the image spreading. Other results are the same as for the first embodiment.

In the second embodiment of this invention, a photosensitive belt 12 formed from a flexible element is used as the image bearing member and the developing roller 520 is used as the developing agent bearing member. Therefore, as shown in FIG. 36, the contact angle $Ø_1$ when the developing agent layer formed on the developing roller 520 and the pre-wet liquid layer formed on the photosensitive belt 12 touch and the separation angle $Ø_2$ when they separate can be made smaller than in the apparatus in related art. As a result the various preconditions for obtaining good images in the first embodiment, such as the characteristics of the liquid developing agent, become less critical.

Figure 37:
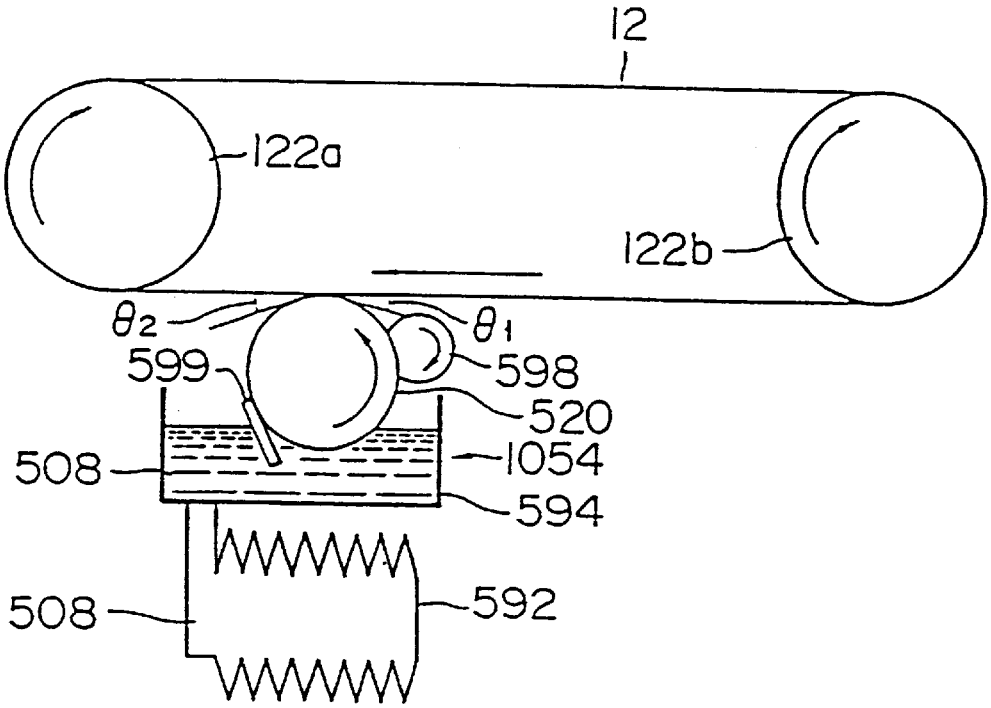
FIG. 37 is an overview of an image bearing member and developing agent supply apparatus that can be used by the modified example of the liquid developing apparatus in the second embodiment of this invention.

The developing apparatus in the second embodiment, like the developing apparatus 1054 shown in FIG. 37, is provided with a bellows pump 592 that both stores and discharges the liquid developing agent 508, a trap 594 that stores the liquid developing agent 508 discharged by the bellows pump 592, a developing roller 520 that is the developing agent bearing member and that is disposed such that the top part is brought into contact with the photosensitive belt 12 and the bottom part is soaked in the liquid developing agent 508 that is stored in the trap 594, a regulatory roller 598 that regulates the thickness of the layer of liquid developing agent 508 applied to the developing roller 520, and a scraper blade 599 that scrapes off the liquid developing agent 508 that has been applied to the developing roller 520. The developing roller 520 is formed from a conductive element such that a developing bias can be applied and, as shown in FIG. 37, rotates in the driven direction in relation to the photosensitive belt 12, that is, in the driven direction in relation to the drive rollers 122*a* and 122*b*. The regulatory roller 598 is formed from an elastic element, is disposed such that it pushes against the developing roller 520, and rotates in the driven direction in relation to the developing roller 520.

A shown in FIG. 37, the photosensitive belt 512 may be driven by two drive rollers 122*a* and 122*b* instead of the three drive rollers shown in FIG. 36. Alternatively, as long as there is at least one roller that drives the photosensitive belt 12, other rollers can be driven rollers.

Figure 38:
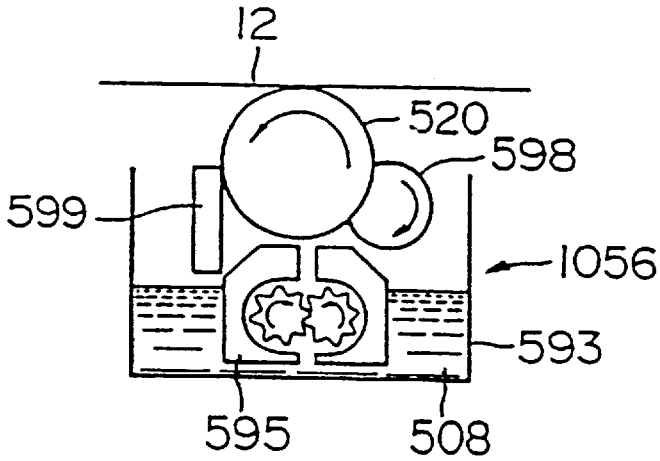
FIG. 38 shows an example of modified developing agent supply apparatus that can be used by the liquid developing apparatus in the second embodiment of this invention.

The developing apparatus 1054 with the above structure draws up the liquid developing agent 508, that has been discharged by the bellows pump 592 and is stored in the trap 594, by means of the developing roller 520, regulates the thickness of and forms a thin film of the developing agent by means of the regulatory roller 598, and then supplies the developing agent to the photosensitive belt 12. FIG. 38 shows another developing apparatus that can be used in the above embodiment. In this apparatus, a double gear pump 595 that is disposed such that it is immersed in the liquid developing agent 508 in the tank 593 is used to draw up the liquid developing agent 508 stored in the tank 593 and thereby supplies the developing agent to the developing roller 520.

Figure 39:
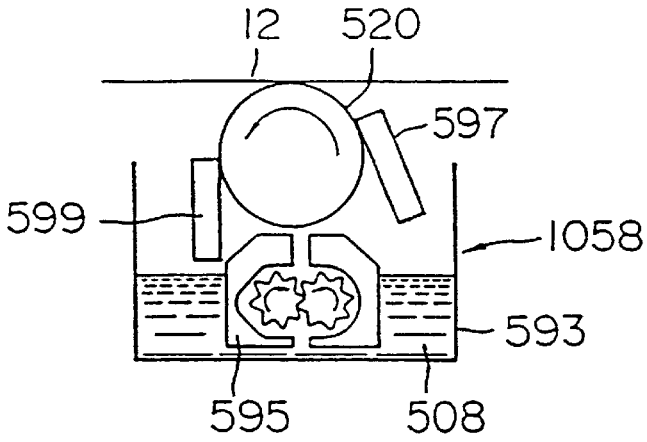
FIG. 39 shows a modified example of the developing agent supply apparatus shown in FIG. 38.

Further, as shown in FIG. 39, a regulatory blade 597 formed from rubber or a rigid material may be used to regulate the thickness of and form a thin film of the liquid developing agent 508 that has been applied to the developing roller 520.

Figure 40:
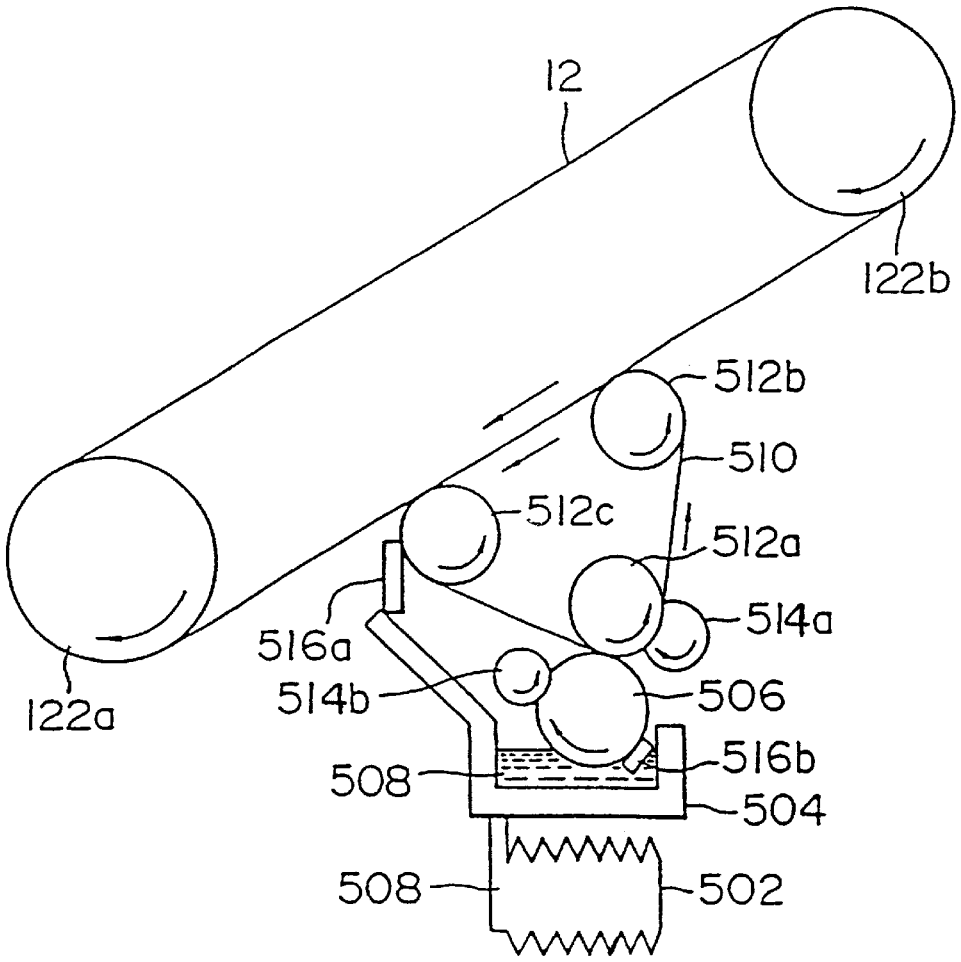
FIG. 40 is an overview of another image bearing member and developing agent supply apparatus that can be used by the liquid developing apparatus in this invention.

FIG. 40 explains the use of the liquid developing agent supply apparatus 50 of the first embodiment in relation to the photosensitive belt 12.

Use of a photosensitive belt 12 formed from a flexible element as the image bearing member and, in addition, use of a developing belt 510 formed from a flexible element as the developing agent bearing member makes it easy to guarantee a suitable gap d between the photosensitive belt 12 and the developing belt 510 and to obtain the same results as those obtainable from the first embodiment.

Figure 41:
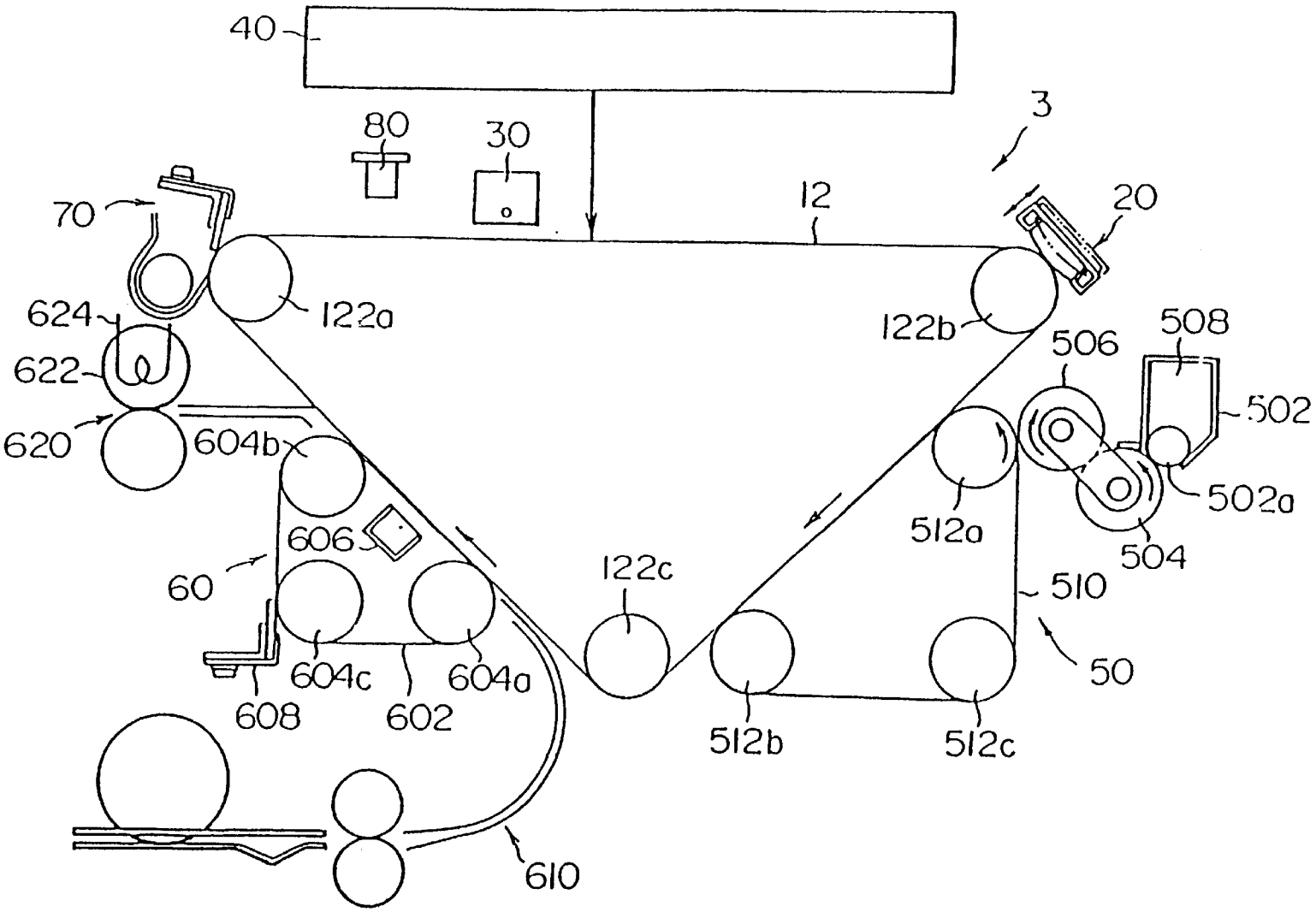
FIG. 41 is an overview of the structure of another modified example of the liquid developing apparatus in this invention.

FIG. 41 explains an apparatus in which a developing belt 510 is used with a photosensitive belt 12 that is supported by three rollers 122*a*, 122*b*, and 122*c*, which may be drive rollers or driven rollers and, instead of the transfer roller 642, a transfer belt 602 is used. The transfer belt is supported by three rollers 604*a*, 604*b*, and 604*c* that are the same as those explained in FIGS. 9 and 34.

Use of a photosensitive belt 12 formed from a flexible element as the image bearing member and, in addition, use of a transfer belt 602 formed from a flexible element as the transfer member allows distribution of the contact pressure when the toner image formed on the latent image on the photosensitive belt 12 and the paper that is the recording medium touch. Thus, the toner image can be transferred to the paper favourably without the image spreading.

For these embodiments, apparatus that uses an organic photosensitive member as the image bearing member has been explained, but this invention is not restricted in this matter. The image bearing member may be any of the photosensitive members used with the Carlson method, may be the type of member used with ionographic or similar methods in which an insulating layer is formed on a conductive body that forms the electrostatic latent image directly, or may be the type of electrostatic recording paper used with electrostatic plotters.

When this invention is implemented as explained above, the two-layer structure of the developing agent layer and the pre-wet liquid layer is maintained while the two layers are in contact during the development process. Moreover, the two layers can be separated at a point within the pre-wet liquid layer at the end of the developing process and the occurrence of inaccuracies in the developing agent layer can be prevented. As a result, the adherence of toner to the non-image parts on the image bearing member can be prevented and clean images can be produced. In addition, during developing, the use of a thin film of highly viscous liquid developing agent that has the toner dispersed at a high concentration enables high-resolution copies to be obtained and facilitates reductions on the size of the apparatus. Furthermore, this invention can provide an environmentally friendly electrostatic latent image liquid developing method and apparatus.

INDUSTRIAL FIELD OF UTILISATION

As described above, the liquid developing method and liquid developing apparatus of this invention allows a highly concentrated liquid developing agent to be used in reduced-size apparatus to develop electrostatic latent images and allows high-resolution copies to be obtained.

What is claimed is:

1. A liquid developing method wherein electrically charged liquid developing agent is used to develop electrostatic latent images formed on the surface of an image bearing member, the method comprising:

forming a film of pre-wet liquid of a selected thickness on a surface of an image bearing member, wherein said pre-wet liquid is silicone oil, forming an electrostatic latent image on the image bearing member, forming a 5 to 40 $\mu$m film of liquid developing agent on the surface of a development agent bearing member, wherein said liquid developing agent is formed by dispersing toner in a dielectric liquid such that the liquid developing agent has a viscosity of 100 to 10,000 mPa.s, bringing the development agent bearing member adjacent the image bearing member to form a gap therebetween wherein the gap is greater than the thickness of the film of liquid developing agent but smaller than the sum of the thicknesses of the pre-wet liquid film and the liquid developing agent film, thereby bringing the film of liquid developing agent on the surface of the development agent bearing member into contact with the pre-wet film on the surface of the image bearing member to develop the image and wherein the developing agent bearing member is formed from a flexible belt.

2. The liquid developing method of claim 1, wherein the selected thickness of the film of pre-wet liquid is 30 $\mu$m or less.

3. The liquid developing method of claim 2, wherein the step of forming the film of the pre-wet liquid further comprises the step of providing a pre-wet liquid supply element formed from a liquid-permeable and liquid retentive element which is impregnated by the pre-wet liquid and the film of pre-wet liquid is formed on the surface of the image bearing member by bringing the pre-wet liquid supply element into contact with the image bearing member.

4. The liquid developing method of claim 3, wherein the pre-wet liquid supply element is formed from a continuously porous sponge that has a three-dimensional mesh structure in which the pores are three-dimensionally continuous.

5. The liquid developing method of claim 4, wherein the above pre-wet liquid supply element is formed in a cylindrical shape and forms the pre-wet liquid film on the surface of the image bearing member by of being made to rotate in accord with the direction of movement of the image bearing member.

6. The liquid developing method of claim 1, wherein the size of the above gap is from 5 to 60 $\mu$m.

7. The liquid developing method of claim 1, wherein the liquid developing agent contains toner with an average particle diameter from 0.1 to 5.0 $\mu$m at a concentration from 5 to 40% by weight of the developing agent.

8. The liquid developing method of claim 1, further including a transfer stage in which the toner image that is developer from the electrostatic latent image is transferred from the image bearing member to a transfer member, wherein either one of or both of the transfer member and the image bearing member is a flexible member, and wherein tension of the or each of the flexible members is adjusted such that an appropriate contact pressure is maintained between the surfaces of the image bearing member and the transfer member.

9. The liquid developing method of claim 1, wherein the viscosity of the dielectric liquid is from 0.5 to 1,000 mPa.s, the dielectric liquid has an electric resistance of $10^{12}$ Ωcm or more, a surface tension of 21 dyne/cm or less, and a boiling point from 100 to 250° C.

10. The liquid developing method of claim 9, wherein the dielectric liquid is silicone oil.

11. The liquid developing method of claim 1, wherein the pre-wet liquid has a viscosity of from 0.5 to 5.0 mPa.s, an electric resistance of $10^{12}$ Ωcm or more, a surface tension of 21 dyne/cm or less, and a boiling point of from 100 to 250° C.

12. The liquid developing method of claim 1, wherein the tension of the flexible belt is adjusted such that the gap is maintained between the surfaces of the image bearing member and the developing agent bearing member.

* * * * *